US011347165B2

(12) United States Patent
Kakehi et al.

(10) Patent No.: US 11,347,165 B2
(45) Date of Patent: May 31, 2022

(54) IMAGE FORMING APPARATUS

(71) Applicant: CANON KABUSHIKI KAISHA, Tokyo (JP)

(72) Inventors: Yutaka Kakehi, Chiba (JP); Ryosuke Tsuruga, Chiba (JP); Tatsuya Kohno, Chiba (JP); Manato Kobayashi, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/350,800

(22) Filed: Jun. 17, 2021

(65) Prior Publication Data

US 2021/0397113 A1 Dec. 23, 2021

(30) Foreign Application Priority Data

Jun. 18, 2020 (JP) ..... JP2020-105703

(51) Int. Cl.
*G03G 15/16* (2006.01)
*G03G 15/00* (2006.01)

(52) U.S. Cl.
CPC ..... *G03G 15/161* (2013.01); *G03G 15/1615* (2013.01); *G03G 15/5029* (2013.01); *G03G 15/6594* (2013.01); *G03G 2215/00738* (2013.01); *G03G 2215/00742* (2013.01); *G03G 2215/00751* (2013.01); *G03G 2215/1614* (2013.01)

(58) Field of Classification Search
CPC ..... G03G 15/1605; G03G 15/161; G03G 15/1615; G03G 15/5029; G03G 15/6588; G03G 15/6591; G03G 15/6594; G03G 2215/00738; G03G 2215/00742; G03G 2215/00751
See application file for complete search history.

(56) References Cited

U.S. PATENT DOCUMENTS 8,406,658 B2 3/2013 Kaseda
2014/0023387 A1* 1/2014 Goto ..... G03G 15/167 399/66
2014/0199089 A1* 7/2014 Ishikawa ..... G03G 15/6558 399/45

(Continued)

FOREIGN PATENT DOCUMENTS

JP 2011-064917 A 3/2011
JP 4680721 B2 5/2011
JP 2014-109609 A 6/2014

*Primary Examiner* — Carla J Therrien
(74) *Attorney, Agent, or Firm* — Venable LLP

(57) ABSTRACT

An image forming apparatus includes an image forming portion, a belt, an inner roller, an outer member, an inner roller position changing mechanism, an acquiring portion, and a controller. In a case that information acquired by the acquiring portion shows that first and second recording materials are coated paper, the controller controls a position changing mechanism so that a position of the inner roller when a toner image is transferred onto the second recording material is changed to a second position. In a case that the information acquired by the acquiring portion shows that the first and second recording materials are plain paper, the controller controls the position changing mechanism so that the position of the inner roller when the toner image is transferred onto the second recording material is maintained at a first position.

10 Claims, 12 Drawing Sheets

(56) References Cited

U.S. PATENT DOCUMENTS

| | | | | |
|---|---|---|---|---|
| 2014/0248068 | A1* | 9/2014 | Nakatsu | G03G 15/1605 399/302 |
| 2014/0294408 | A1* | 10/2014 | Yoshioka | G03G 15/0136 399/44 |
| 2014/0294411 | A1* | 10/2014 | Yoshioka | G03G 15/6594 399/45 |
| 2019/0354044 | A1* | 11/2019 | Torimaru | G03G 15/1675 |
| 2021/0263459 | A1* | 8/2021 | Inuzuka | G03G 15/5008 |
| 2021/0356886 | A1* | 11/2021 | Tajima | G03G 15/6594 |
| 2021/0397111 | A1* | 12/2021 | Inuzuka | G03G 15/6558 |
| 2021/0397112 | A1* | 12/2021 | Tsuruga | G03G 15/161 |

* cited by examiner (a)

(b)

(a)

(b)

IMAGE FORMING APPARATUS

FIELD OF THE INVENTION AND RELATED ART

The present invention relates to an image forming apparatus for forming a toner image on a recording material.

Conventionally, among the image forming apparatuses of the electrophotographic type, there is an image forming apparatus using an endless belt as an image bearing member for bearing a toner image. As such a belt, for example, there is an intermediary transfer belt used as a second image bearing member for feeding a sheet-like recording material such as paper from a photosensitive member or the like as a first image bearing member. In the following principally, an image forming apparatus of an intermediary transfer type including an intermediary transfer belt will be described as an example.

In the image forming apparatus using the intermediary transfer belt, a toner image formed on the photosensitive member or the like is primary-transferred onto the intermediary transfer belt at a primary transfer portion. Then, the toner image primary-transferred on the intermediary transfer belt is secondary-transferred onto the recording material at a secondary transfer portion. By an inner member (inner secondary transfer member) provided on an inner peripheral surface side and an outer member (outer secondary transfer member) provided on an outer peripheral surface side, the secondary transfer portion (secondary transfer nip) which is a contact portion between the intermediary transfer belt and the outer member is formed. As the inner member, an inner roller (inner secondary transfer roller) which is one of a plurality of stretching rollers for stretching the intermediary transfer belt is used. As the outer member, an outer roller (outer secondary transfer roller) which is provided in a position opposing the inner roller while nipping the intermediary transfer belt between itself and the inner roller and which is pressed toward the inner roller is used in many instances. Further, a voltage of a polarity opposite to a charge polarity of toner is applied to the outer roller, (or a voltage of the same polarity as the charge polarity of the toner is applied to the inner roller) so that the toner image is secondary-transferred from the intermediary transfer belt onto the recording material in the secondary transfer portion. In general, with respect to a feeding direction of the recording material, on a side upstream of the secondary transfer portion, a feeding guide for guiding the recording material to the secondary transfer portion is provided.

Incidentally, as regards the recording material, a "leading end" and a "trailing end" refer to the leading end and the trailing end, respectively, with respect to a recording material feeding direction.

In recent years, with diversification of the recording material in a commercial printing market, it is required that image quality specifications are satisfied in various conditions from low-rigidity thin paper to high-rigidity thick paper. Here, depending on rigidity of the recording material, behavior of the recording material changes in the neighborhood of the secondary transfer portion on sides upstream and downstream of the secondary transfer portion with respect to the recording material feeding direction and has the influence on an image which is a product in some instances.

Further, for example, depending on the rigidity of the recording material, when the leading end or the trailing end of the recording material enters the secondary transfer portion, image defect due to vibration of the intermediary transfer belt in the neighborhood of an upstream portion of the secondary transfer portion with respect to a rotational direction of the intermediary transfer belt ("shock image" at the leading end or the trailing end of the recording material) is liable to occur in some instances. For example, in the case where the recording material is "thin paper" which is an example of the recording material with low rigidity, in the neighborhood of the secondary transfer portion on the side downstream of the secondary transfer portion with respect to the recording material feeding direction, the intermediary transfer belt and the recording material stick to each other, so that a jam (paper jam) occurs in some instances due to "improper separation" of the recording material from the intermediary transfer belt.

Further, in the case where the recording material is "thick paper" which is an example of the recording material with high rigidity, when a trailing end of the recording material with respect to the recording material feeding direction passes through the feeding guide, a trailing end portion (the trailing end or a region close to the trailing end) of the recording material collides with the intermediary transfer belt in some instances. By this, with respect to the recording material feeding direction, an attitude of the intermediary transfer belt in the neighborhood of the secondary transfer portion on the upstream side is disturbed, so that an image defect (by "jumping-up") such as a stripe-shaped image disturbance or the like extending in a direction substantially perpendicular to the recording material feeding direction occurs in some instances.

Further, for example, in the case of the "thick paper" which is an example of the recording material with high rigidity, due to the high rigidity of the recording material, a gap between the intermediary transfer belt and the recording material is liable to be formed in the neighborhood of an inlet of the secondary transfer portion. Further, by the influence of a transfer electric field, electric discharge occurs in the gap, so that the toner image scatters and thus image defect ("scattering") occurs in some instances.

Therefore, a constitution in which a position of the secondary transfer portion and a shape of a stretched surface of the intermediary transfer belt in the neighborhood of an inlet of the secondary transfer portion (herein, these are simply referred to as also a "state of the transfer portion") are changed depending on the recording material has been known.

For example, in Japanese Laid-Open Patent Application (JP-A) 2011-64917, a constitution in which a position of an outer roller is switched depending on a thickness of the recording material or information on a basis weight of the recording material and thus a position (shape) of the secondary transfer portion is changed and thus the "jumping-up" occurring at the trailing end portion of thick paper is alleviated has been disclosed.

Further, in JP-A 2014-109609, a constitution in which a position of an outer roller is changed depending on the thickness of the recording material or the like and thus a discharge angle of the recording material from the secondary transfer portion is controlled and thus a "separation property" of the recording material from the intermediary transfer belt is improved has been disclosed.

For example, in Japanese Patent No. 4680721, a constitution in which an urging (pressing) member for suppressing the "shock image" by urging (pressing) the intermediary transfer belt from a back surface (side) of the intermediary transfer belt is provided and in which a penetration amount (entering amount) of this urging member against the intermediary transfer belt is changed depending on a thickness of the recording material has been disclosed.

Further, a constitution in which an urging member contacting an inner peripheral surface of the intermediary transfer belt in the neighborhood of an inlet of the secondary transfer portion is provided and in which a contact region between the intermediary transfer belt and the recording material is increased and a gap therebetween is decreased and thus the "stretching" can be suppressed has been known.

However, in the case where the constitution in which the position of the secondary transfer portion and the stretched surface of the intermediary transfer belt in the neighborhood of the inlet of the secondary transfer portion are changed depending on information on the recording material, such as a thickness or a basis weight, is employed, a time required for changing these states of the secondary transfer portion is needed.

Here, for example, in a commercial printing or the like, a job in which images are formed on a plurality of recording materials (herein, this job is also referred to as a "mixed job") has been executed in some instances. For that reason, in the case where the mixed job in which the images are formed on both the recording material for which there is no need to change the state of the secondary transfer portion and the recording material for which there is a need to change the state of the secondary transfer portion, there arises a problem such that productivity lowers correspondingly to a time required to change the state of the secondary transfer portion between these recording materials.

SUMMARY OF THE INVENTION

A principal object of the present invention is to provide an image forming apparatus capable of suppressing a lowering in productivity of a mixed job while improving a recording material feeding property and a transfer property depending on a recording material.

The object has been accomplished by the image forming apparatus according to the present invention.

According to an aspect of the present invention, there is provided an image forming apparatus comprising: an image forming portion configured to form a toner image on an image bearing member; an endless belt onto which the toner image is transferred from the image bearing member; an inner roller stretching the endless belt in contact with an inner peripheral surface of the endless belt; an outer member forming a transfer nip, where the toner image is transferred from the endless belt onto a recording material, in cooperation with the inner roller in contact with an outer peripheral surface of the endless belt; a position changing mechanism configured to change a position of the transfer nip with respect to a circumferential direction of the inner roller by moving the inner roller, wherein the position changing member is capable of changing a position of the inner roller to a plurality of positions including a first position and a second position positioned upstream of the first position with respect to a rotational direction of the endless belt; an acquiring portion configured to acquire first information on a thickness of the recording material and second information on a surface property of the recording material; and a controller configured to control the position changing mechanism on the basis of the first information and the second information which are acquired by the acquiring portion, wherein during an image forming job for forming images on a plurality of recording materials including a first recording material and a second recording material subsequent to the first recording material, in a case that the position of the inner roller when the toner image is transferred onto the first recording material is the first position and that the first information acquired by the acquiring portion shows that a thickness of the second recording material is a first threshold or more and a second threshold or less, in a case that the second information acquired by the acquiring portion shows that both the first recording material and the second recording material are coated paper, the controller controls the position changing mechanism so that the position of the inner roller when the toner image is transferred onto the second recording material is changed to the second position, and in a case that the second information acquired by the acquiring portion shows that both the first recording material and the second recording material are plain paper, the controller controls the position changing mechanism so that the position of the inner roller when the toner image is transferred onto the second recording material is maintained at the first position.

Further features of the present invention will become apparent from the following description of exemplary embodiments with reference to the attached drawings.

Figure 2:
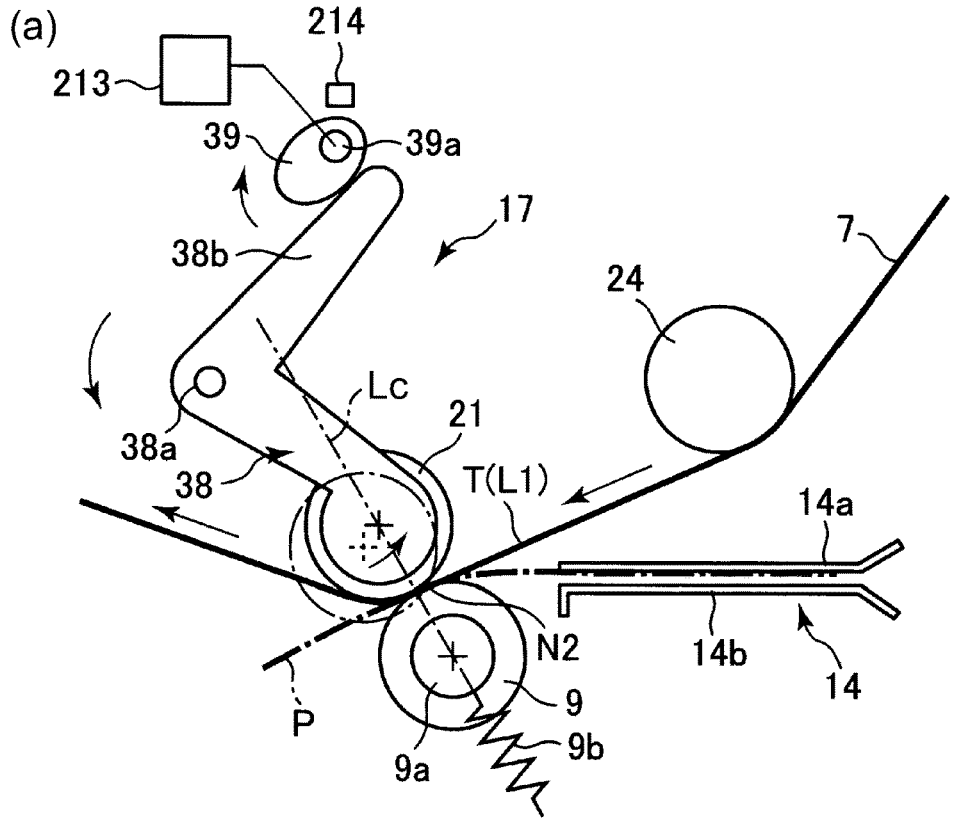
Figure 2:
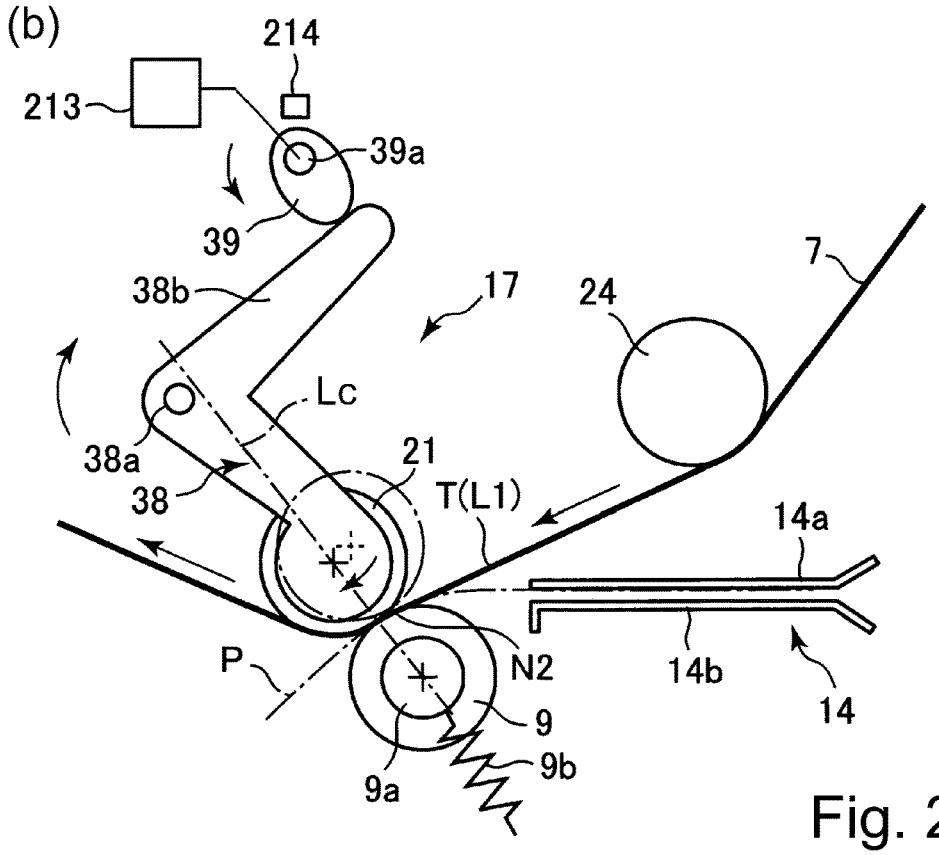

Parts (a) and (b) FIG. 2 are schematic state views showing an offset mechanism.

Figure 3:
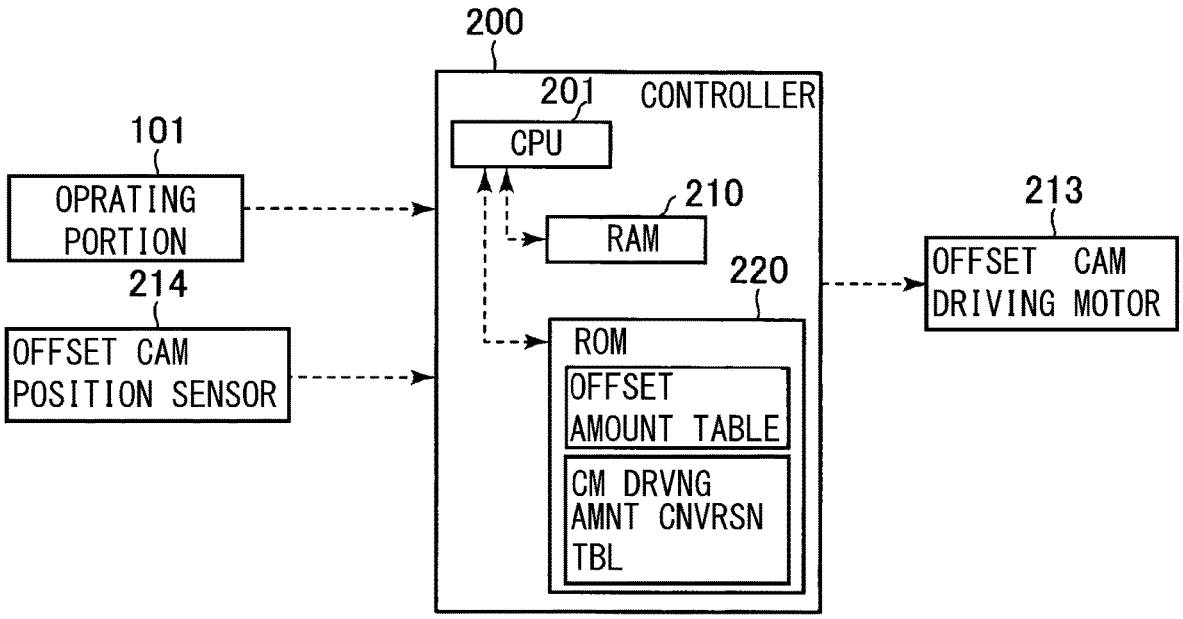

FIG. 3 is a schematic block diagram showing a control mode of a principal part of the image forming apparatus according to the embodiment 1.

Figure 4:
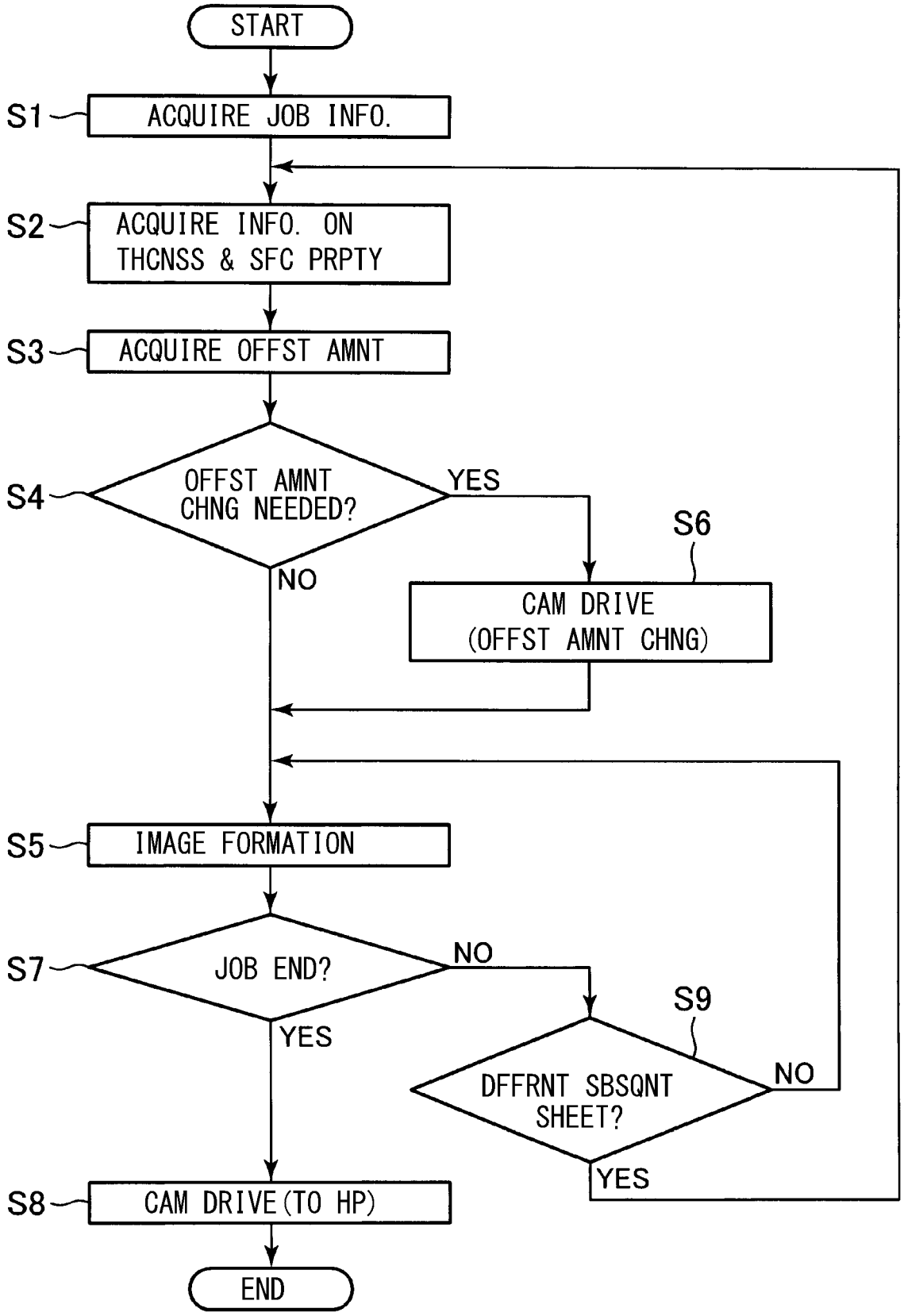

FIG. 4 is a flowchart of control in the embodiment 1.

Figure 5:
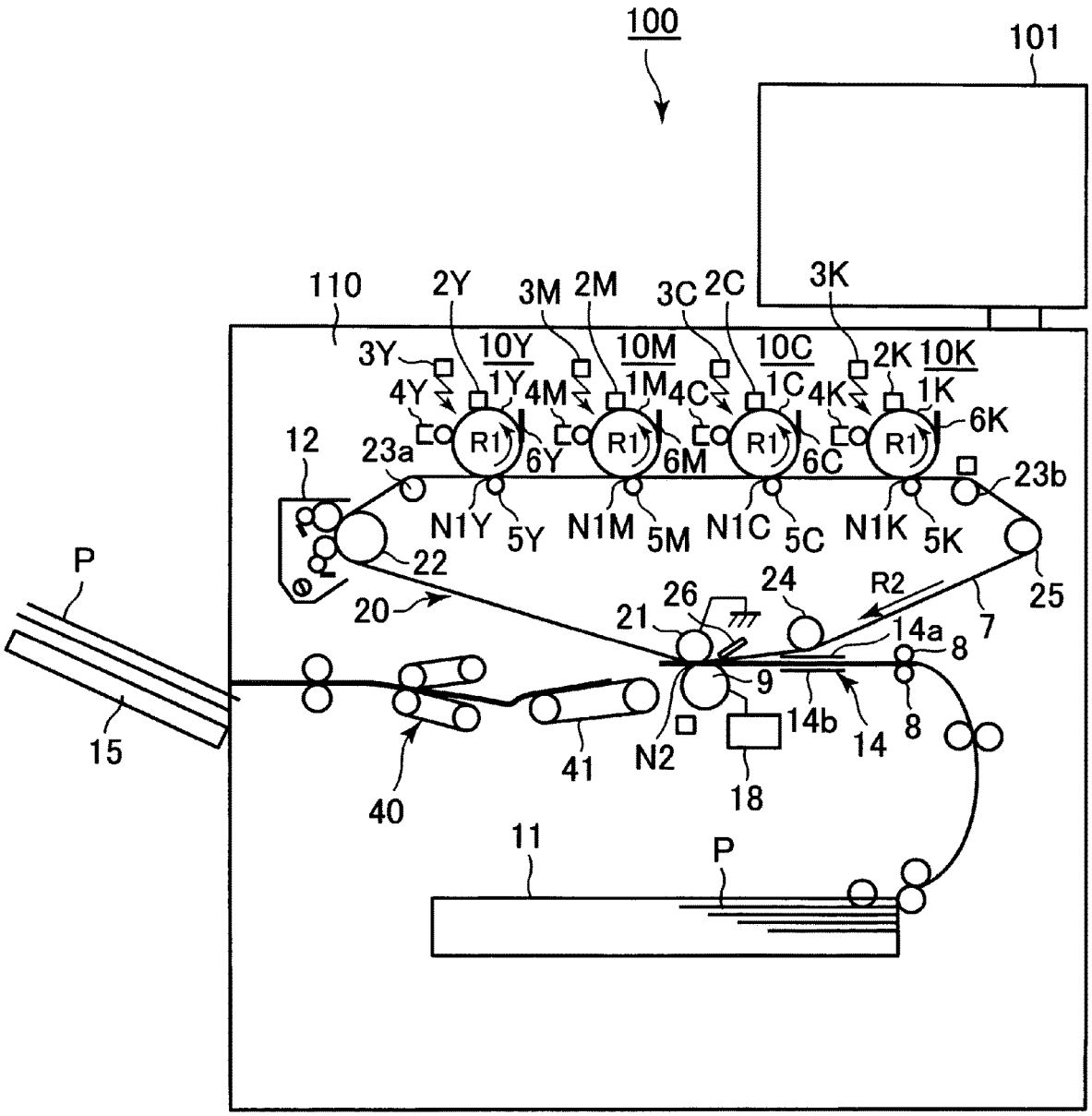

FIG. 5 is a schematic sectional view of an image forming apparatus according to an embodiment 2.

Figure 6:
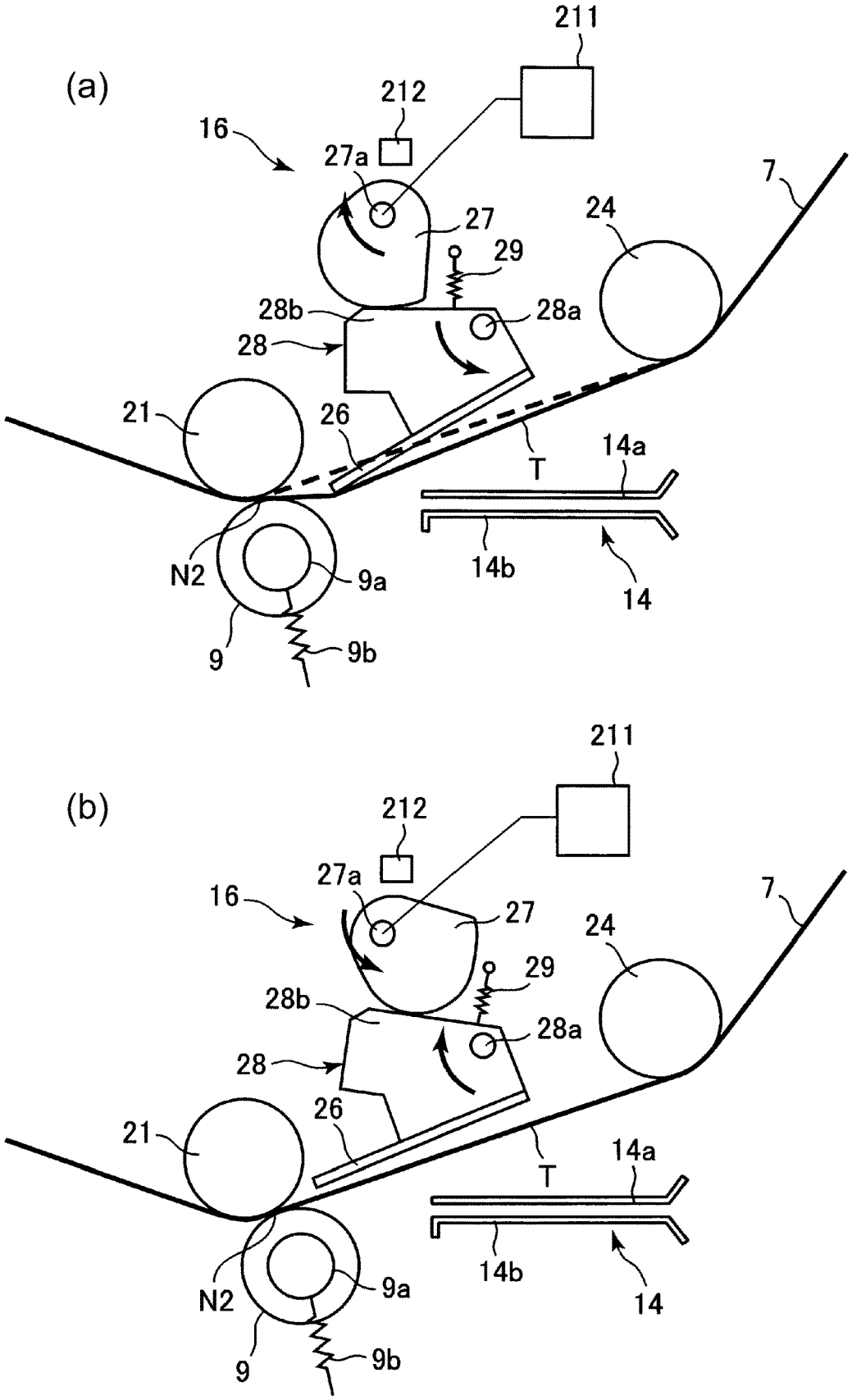

Parts (a) and (b) of FIG. 6 are schematic side views showing an urging mechanism.

Figure 7:
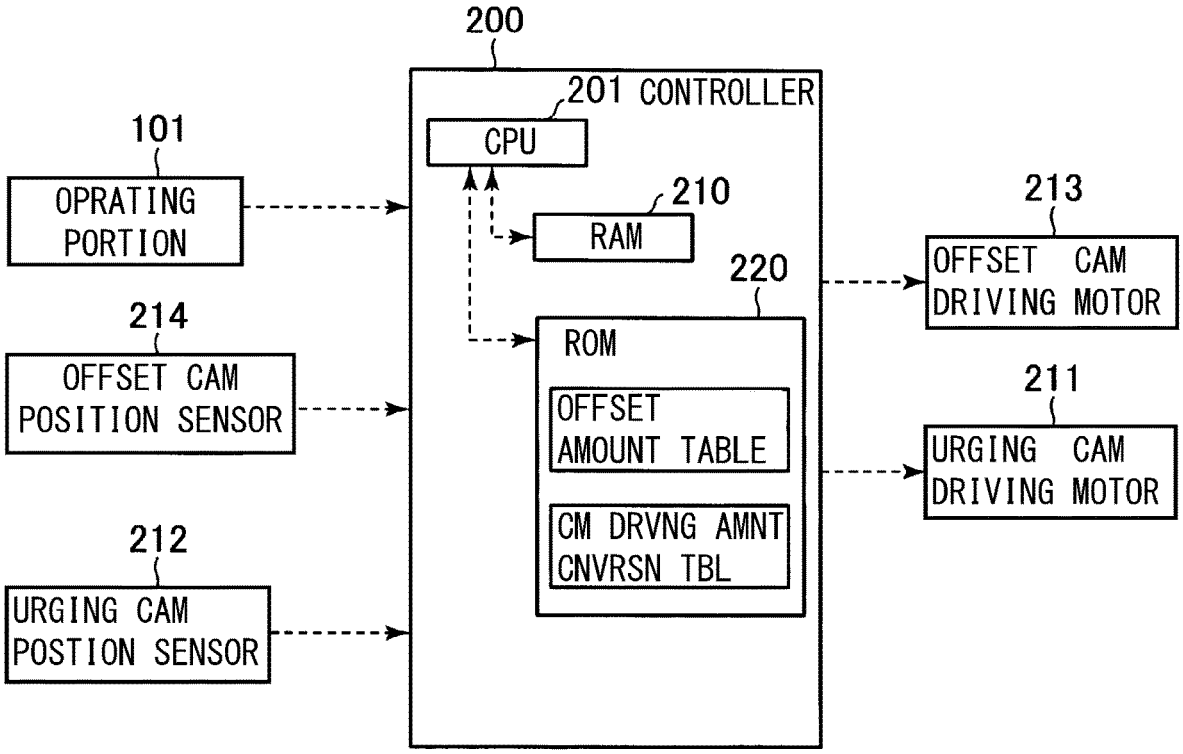

FIG. 7 is a schematic block diagram showing a control mode of a principal part of the image forming apparatus of an embodiment 2.

Figure 8:
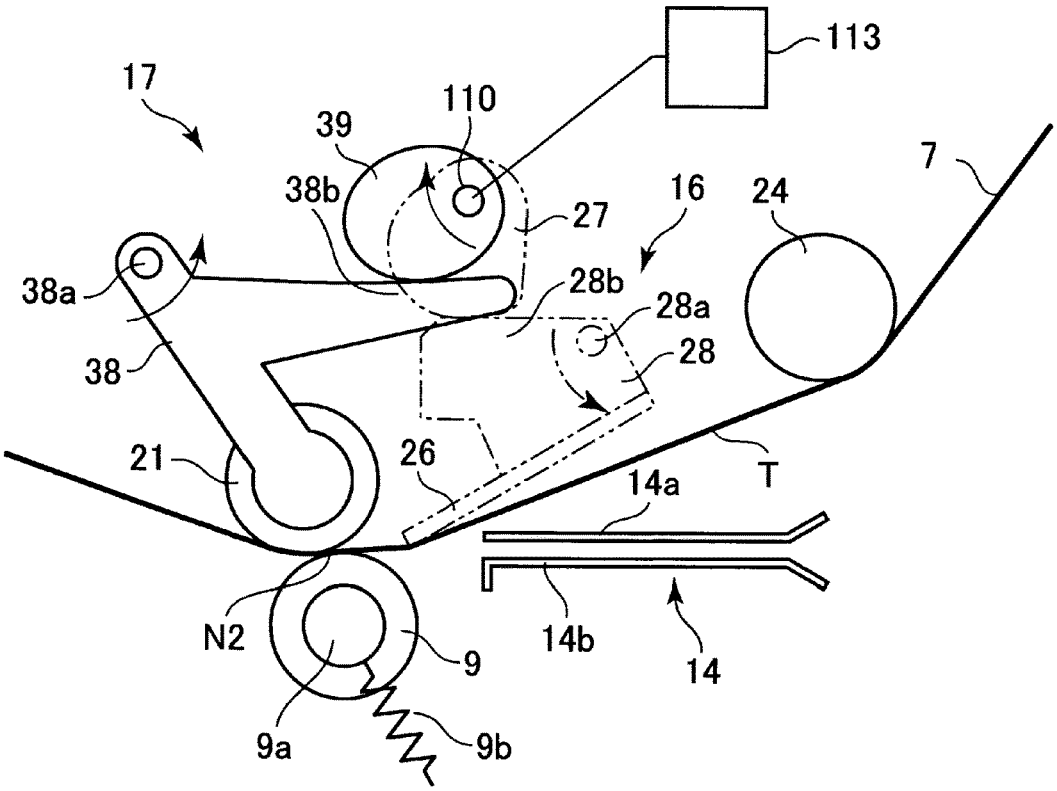
Figure 8:
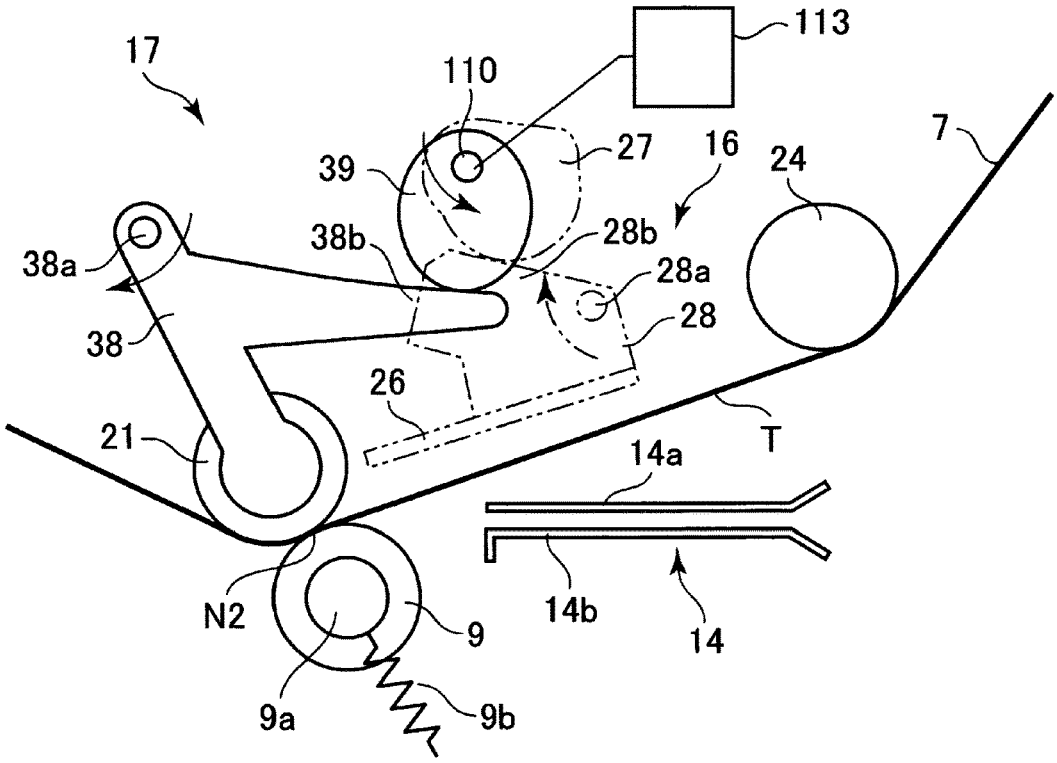

Parts (a) and (b) of FIG. 8 are schematic side views showing another example of the offset mechanism and the urging mechanism.

Figure 9:
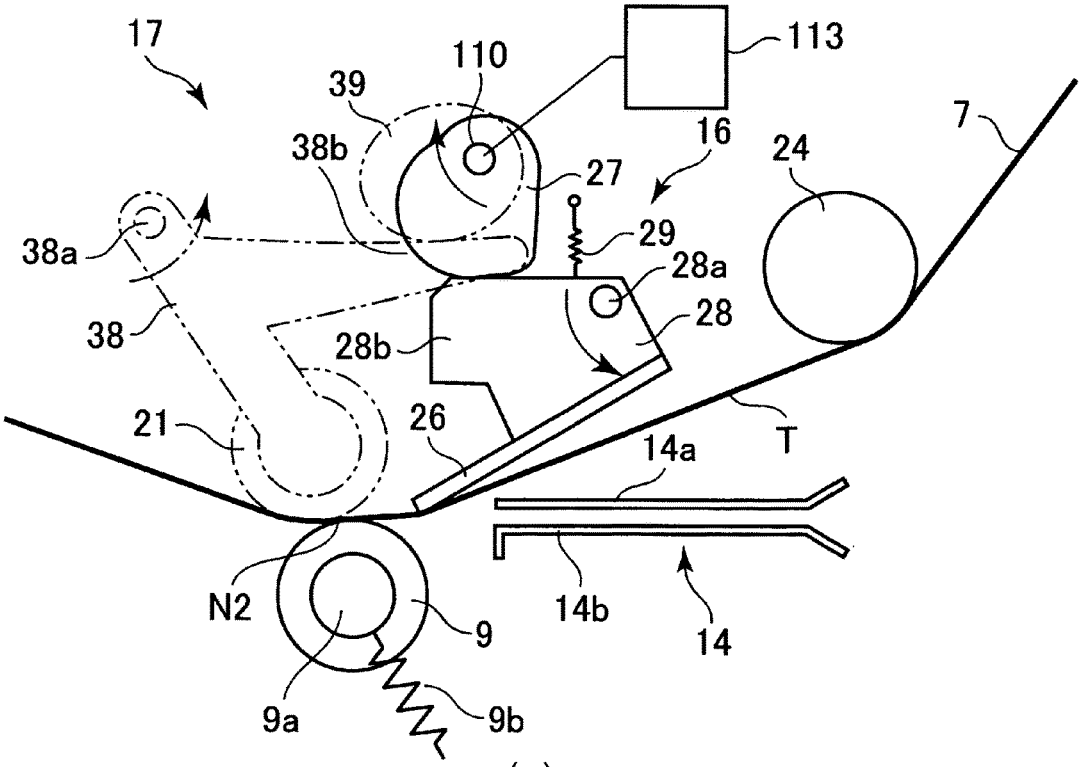
Figure 9:
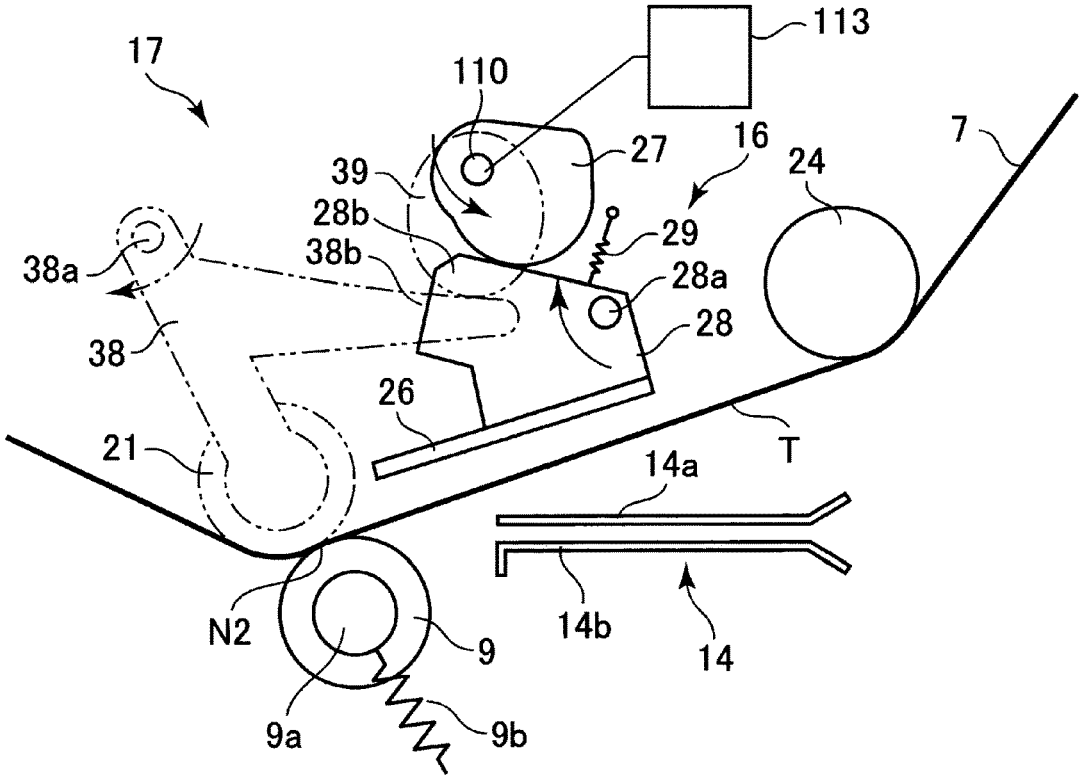

Parts (a) and (b) of FIG. 9 are schematic side views showing another example of the offset mechanism and the urging mechanism.

Figure 10:
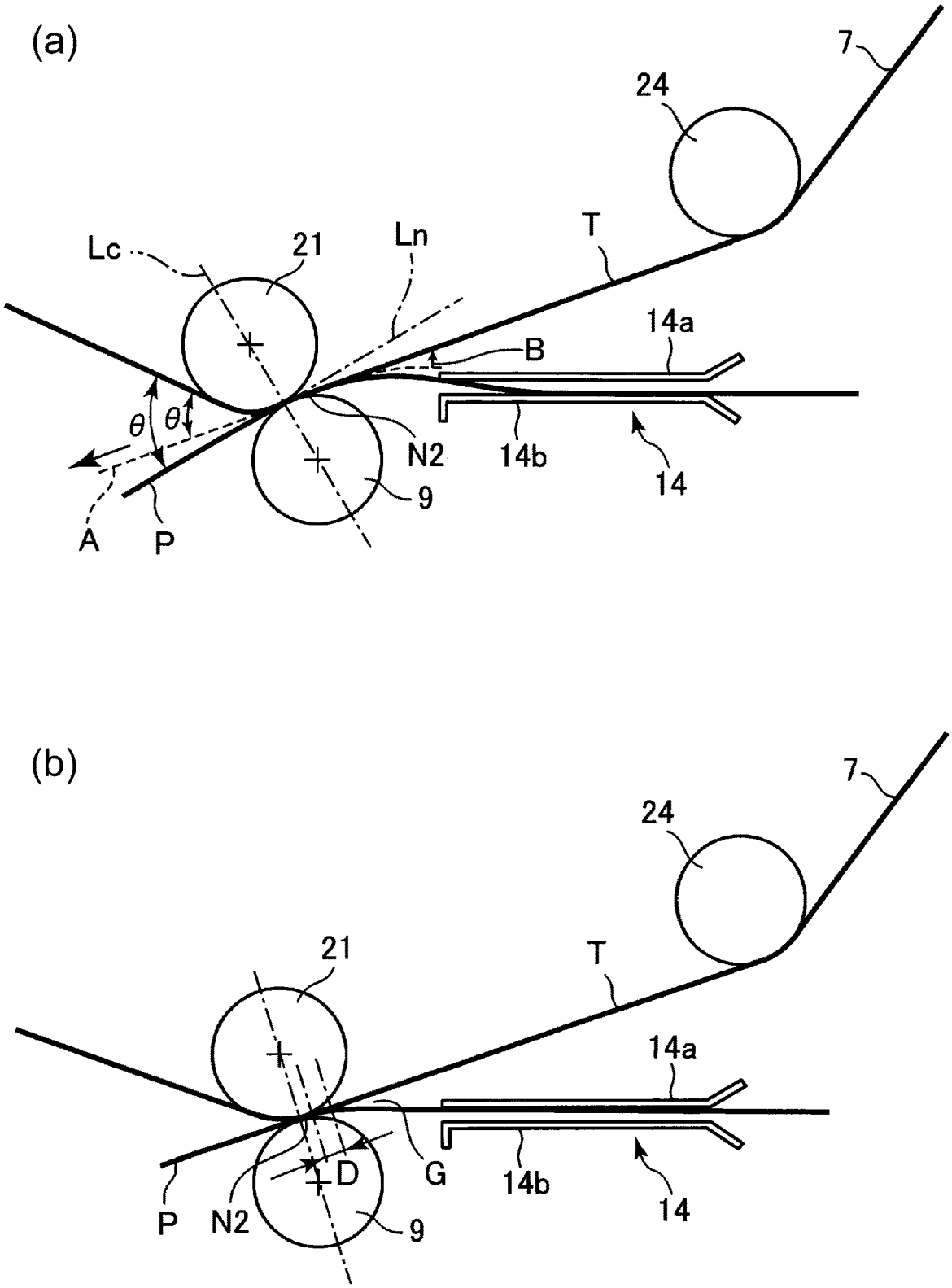

Parts (a) and (b) of FIG. 10 are schematic sectional views for illustrating a feeding attitude of a recording material.

Figure 11:
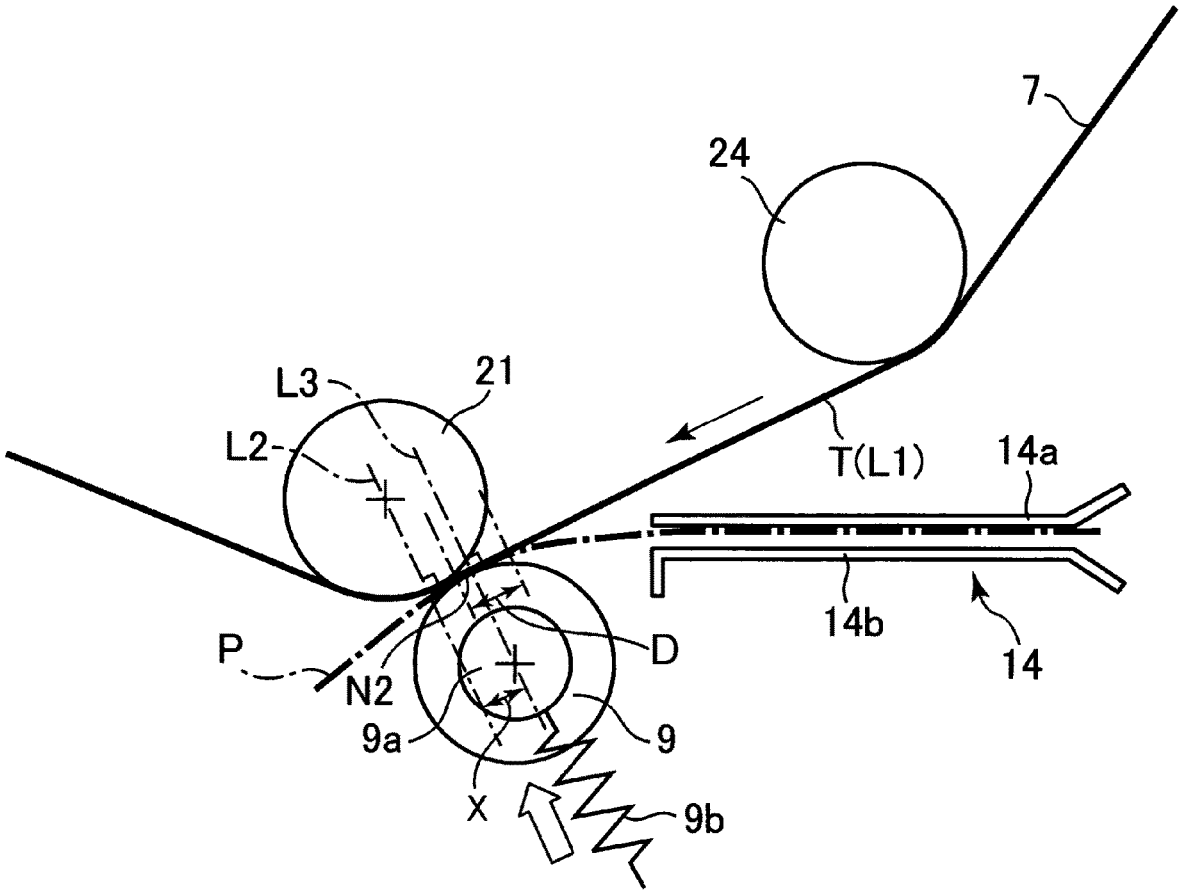

FIG. 11 is a schematic sectional view for illustrating an offset amount.

Figure 12:
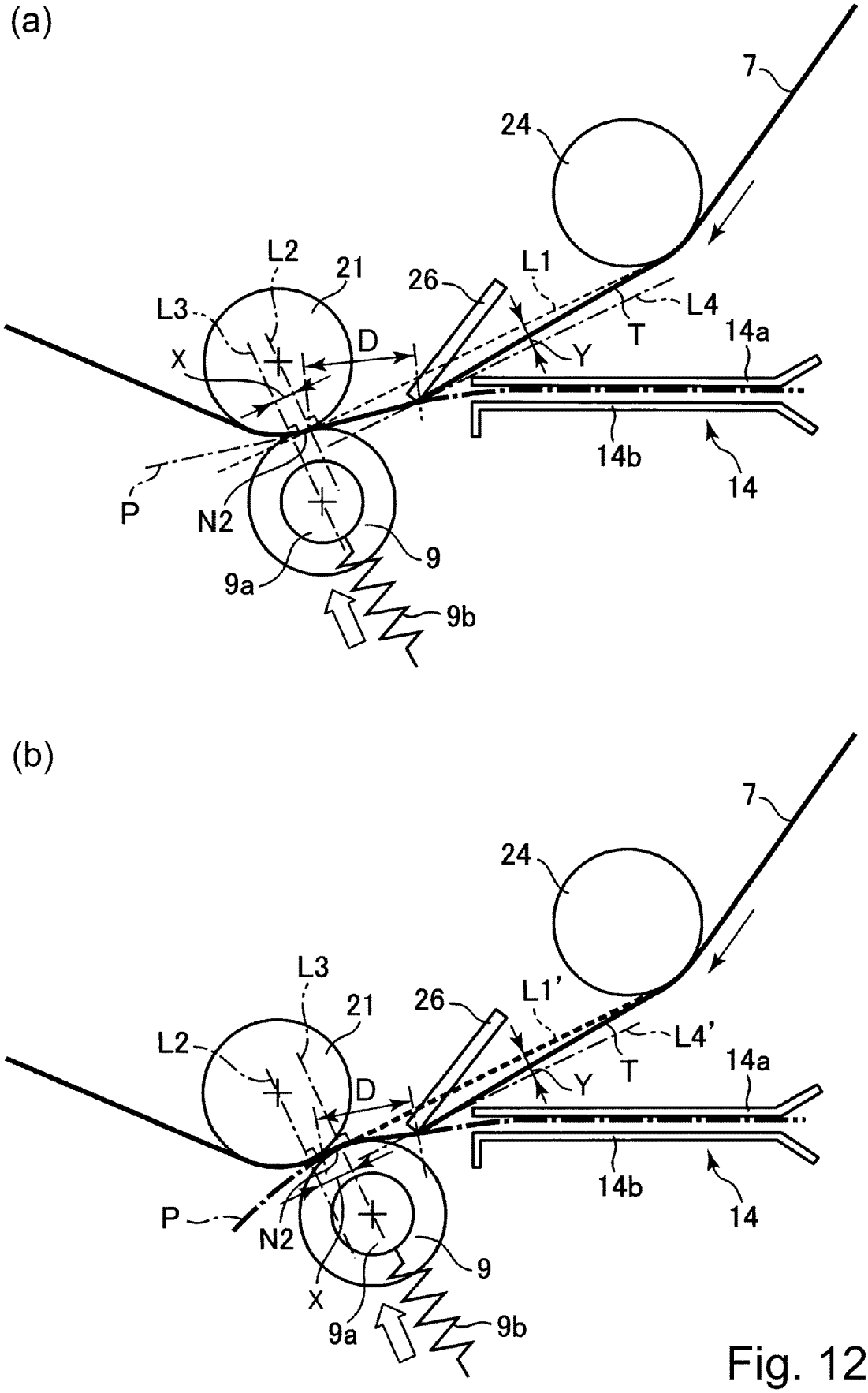

Parts (a) and (b) of FIG. 12 are schematic sectional views for illustrating a penetration amount (urging amount).

DESCRIPTION OF THE EMBODIMENTS

In the following, an image forming apparatus according to the present invention will be specifically described with reference to the drawings.

Embodiment 1

1. General Constitution and Operation of Image Forming Apparatus

Figure 1:
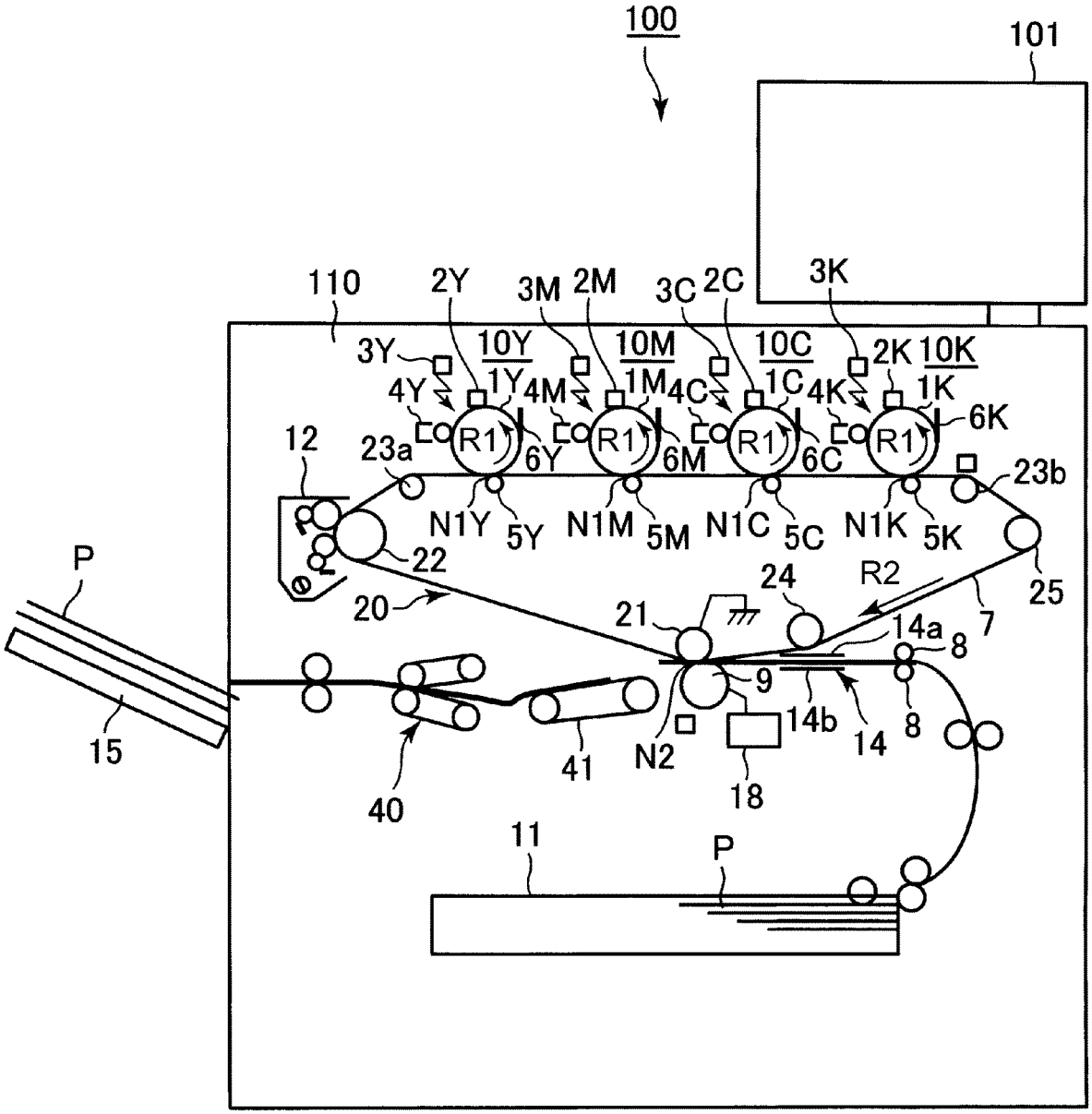
FIG. 1 is a schematic sectional view of an image forming apparatus according to an embodiment 1.

FIG. 1 is a schematic sectional view of an image forming apparatus 100 of this embodiment. The image forming apparatus 100 of this embodiment is a tandem multi-function machine (having functions of a copying machine, a printer and a facsimile machine) of an intermediary transfer type. For example, in accordance with an image signal sent from an external device, the image forming apparatus 100 is capable of forming a full-color image on a sheet-like recording material (a transfer material, a sheet material, a recording medium, media) P such as paper by using an electrophotographic type process.

The image forming apparatus 100 includes, as a plurality of image forming portions (stations), four image forming portions 10Y, 10M, 10C and 10K for forming images of yellow (Y), magenta (M), cyan (C) and black (K). These image forming portions 10Y, 10M, 10C and 10K are disposed in line along a movement direction of an image transfer surface disposed substantially parallel to an intermediary transfer belt 7. As regards elements of the image forming portions 10Y, 10M, 10C and 10K having the same or corresponding functions or constitutions, suffixes Y, M, C and K for representing the elements for associated colors are omitted, and the elements will be collectively described in some instances. In this embodiment, the image forming portion 10 is constituted by including a photosensitive drum 1 (1Y, 1K, 1C, 1K), a charging device 2 (2Y, 2M, 2C, 2K), an exposure device 3 (3Y, 3M, 3C, 3K), a developing device 4 (4Y, 4M, 4C, 4K), a primary transfer roller 5 (5Y, 5M, 5C, 5K), a cleaning device 6 (6Y, 6M, 6C, 6K) and the like, which are described later.

To the photosensitive drum 1 which is a rotatable drum-shaped (cylindrical) photosensitive member (electrophotographic photosensitive member) as a first image bearing member for bearing a toner image, a driving force is transmitted from a driving motor (not shown) as a driving source, so that the photosensitive drum 1 is rotationally driven in an arrow R1 direction (counterclockwise direction) of FIG. 1.

A surface of the rotating photosensitive drum 1 is electrically charged uniformly to a predetermined polarity (negative in this embodiment) and a predetermined potential by the charging device 2 as a charging means. During a charging process, to the charging device 2, a predetermined charging voltage is applied from a charging voltage source (not shown). The charged surface of the photosensitive drum 1 is subjected to scanning exposure to light depending on an image signal by the exposure device 3 as an exposure means (electrostatic image forming means), so that an electrostatic image (electrostatic latent image) is formed on the photosensitive drum 1. In this embodiment, the exposure device 3 is constituted by a laser scanner device for irradiating the surface of the photosensitive drum 1 with laser light modulated depending on an image signal (image information). The electrostatic image formed on the photosensitive drum 1 is developed (visualized) by supplying toner as a developer by the developing device 4 as a developing means, so that a toner image (developer image) is formed on the photosensitive drum 1. In this embodiment, the toner charged to the same polarity (negative polarity in this embodiment) as a charge polarity of the photosensitive drum 1 is deposited on an exposed portion (image portion) of the photosensitive drum 1 where an absolute value of the potential is lowered by exposing to light the surface of the photosensitive drum 1 after the photosensitive drum 1 is uniformly charged (reverse development). The developing device 4 includes a developing roller, which is a rotatable developer carrying member, for feeding the developer to a developing position which is an opposing portion to the photosensitive drum 1 while carrying the developer. The developing roller is rotationally driven by transmitting thereto a driving force from a driving system for the photosensitive drum 1, for example. Further, during development, to the developing roller, a predetermined developing voltage is applied from a developing voltage source (not shown).

As a second image bearing member for bearing the toner image, the intermediary transfer belt 7 which is a rotatable intermediary transfer member constituted by an endless belt is provided so as to oppose the four photosensitive drums 1Y, 1M, 1C and 1K. The intermediary transfer belt 7 is extended around and stretched under predetermined tension by a plurality of stretching (supporting) rollers including a driving roller 22, an upstream auxiliary roller 23*a*, a downstream auxiliary roller 23*b*, a tension roller 25, a pre-secondary transfer roller 24 and an inner roller 21. The driving roller 22 transmits a driving force to the intermediary transfer belt 7. The tension roller 24 imparts the predetermined tension to the intermediary transfer belt 7, and controls the tension of the intermediary transfer belt 7 to a certain level. The pre-secondary transfer roller 22 forms a surface of the intermediary transfer belt 7 in the neighborhood of a secondary transfer nip N2 (described later) on a side upstream of the secondary transfer nip N2 with respect to a rotational direction (surface movement direction, traveling direction) of the intermediary transfer belt 7. The inner roller (secondary transfer opposite roller, inner member) 21 functions as an opposing member (opposite electrode) of an outer roller 9 (described later). The upstream auxiliary roller 23*a* and the downstream auxiliary roller 23*b* form the image transfer surface disposed substantially horizontally. The driving roller 22 is rotationally driven by transmission of the driving force thereto from a belt driving motor (not shown) as a driving source. By this, the driving force is inputted from the driving roller 22 to the intermediary transfer belt 7, so that the intermediary transfer belt 7 is rotated (circulated and moved) in an arrow R2 direction in FIG. 1. In this embodiment, the intermediary transfer belt 7 is rotationally driven so that a peripheral speed thereof is 150-470 mm/sec. Of the plurality of stretching rollers, the stretching rollers other than the driving roller 22 are rotated by rotation of the intermediary transfer belt 7.

On the inner peripheral surface side of the intermediary transfer belt 7, the primary transfer rollers 5Y, 5M, 5C and 5K which are roller-like primary transfer members as primary transfer means are disposed correspondingly to the respective photosensitive drums 1Y, 1M, 1C and 1K. The primary transfer roller 5 is urged toward an associated photosensitive drum 1 through the intermediary transfer belt 7, whereby a primary transfer nip N1 which is a contact portion between the photosensitive drum 1 and the intermediary transfer belt 7 is formed.

The toner image formed on the photosensitive drum 1 as described above is primary-transferred onto the rotating intermediary transfer belt 7 at the primary nip N1 by the action of the primary transfer roller 5. During the primary transfer, to the primary transfer roller 23, a primary transfer voltage which is a DC voltage of an opposite polarity (positive in this embodiment) to a normal charge polarity (the charge polarity of the toner during the development) of the toner is applied by an unshown primary transfer voltage source. For example, during full-color image formation, the color toner images of yellow, magenta, cyan and black formed on the respective photosensitive drums 1 are successively primary-transferred superposedly onto the same image forming region of the intermediary transfer belt 7. In this embodiment, the primary transfer nip N1 is an image forming position where the toner image is formed on the intermediary transfer belt 7. The intermediary transfer belt 7 is an example of an endless belt rotatable while feeding the toner image carried in the image forming position.

On an outer peripheral surface side of the intermediary transfer belt 7, at a position opposing the inner roller 21, an outer roller (secondary transfer roller, outer member) 9 which is a roller-like secondary transfer member (rotatable transfer member) as a secondary transfer means is provided. The outer roller 9 is urged toward the inner roller 21 through the intermediary transfer belt 7 and forms the secondary transfer nip N2 as a secondary transfer portion which is a contact portion between the intermediary transfer belt 7 and the outer roller 9. The toner images formed on the intermediary transfer belt 7 as described above are secondary-transferred onto a recording material P sandwiched and fed by the intermediary transfer belt 7 and the outer roller 9 at the secondary transfer portion N2 by the action of the outer roller 9. In this embodiment, during the secondary transfer, to the outer roller 9, a secondary transfer voltage which is a DC voltage, subjected to constant-voltage control, of the opposite polarity (positive in this embodiment) to the normal charge polarity of the toner is applied by a secondary transfer voltage source (high-voltage applying means) 18. In this embodiment, for example, the secondary transfer voltage of +1 to +7 kV is applied and thus a secondary transfer current of +40 to +120 μA is caused to flow, so that the toner images are transferred from the intermediary transfer belt 7 onto the recording material P. In this embodiment, the inner roller 21 is electrically grounded (connected to the ground). Incidentally, the inner roller 21 is used as a secondary transfer member and a secondary transfer voltage of the same polarity as the normal charge polarity of the toner is applied thereto, and the outer roller 9 is used as an opposite electrode and may also be electrically grounded.

The recording material P is fed to the secondary transfer nip N2 by being timed to the toner image on the intermediary transfer belt 7. That is, the recording material P accommodated in a recording material cassette 11 as a recording material accommodating portion is fed to a pair of registration rollers (registration roller pair) 8 which is a feeding member as a feeding means and is once stopped by the registration rollers 8. Then, this recording material P is sent into the secondary transfer nip N2 by rotational drive of the registration rollers 8 so that the toner image on the intermediary transfer belt 7 coincides with a desired image forming region on the recording material P in the secondary transfer nip N2.

With respect to the feeding direction of the recording material P, a feeding guide 14 for guiding the recording material P to the secondary transfer nip N2 is provided downstream of the registration rollers pairs 8 and upstream of the secondary transfer nip N2. The feeding guide 14 is constituted by including a first guiding member 14*a* contactable to a front surface of the recording material P (i.e., a surface onto which the toner image is to be transferred immediately after the recording material P passes through the feeding guide 14) and a second guiding member 14*b* contactable to a back surface of the recording material P (i.e., a surface opposite from the front surface). The image guiding member 14*a* and the second guiding member 14*b* are disposed opposed to each other, and the recording material P passes through between these members. The first guiding member 14*a* restricts movement of the recording material P in a direction toward the intermediary transfer belt 7. The second guiding member 14*b* restricts movement of the recording material P in a direction away from the intermediary transfer belt 7.

The recording material P on which the toner images are transferred is fed by a pre-fixing feeding device 41 toward a fixing device 15 as a fixing means. The pre-fixing feeding device 41 includes a rotatable belt member formed, at a central portion with respect to a direction substantially perpendicular to the feeding direction of the recording material P, of a rubber material such as EPDM, having a width of 100-110 mm with respect to the direction and a thickness of 1-3 mm. The pre-fixing feeding device 41 feeds the recording material P while carrying the recording material P on the belt member. This belt member is perforated with holes of 3-7 mm in diameter, and air is sucked from the inner peripheral surface side, so that a carrying force of the recording material P is enhanced and thus a feeding property of the recording material P is stabilized. The fixing device 40 heats and presses the recording material P carrying thereon unfixed toner images in a process in which the recording material P is nipped and fed by a rotatable fixing member pair and thus fixes (melts) the toner images on the surface of the recording material P. Thereafter, the recording material P on which the toner images are fixed is discharged (outputted) to a discharge tray 15 provided on an outside of an apparatus main assembly 110 of the image forming apparatus 100 by a discharging roller pair or the like which is a discharging member as a discharging means.

On the other hand, toner (primary transfer residual toner) remaining on the photosensitive drum 1 after the primary transfer is removed and collected from the surface of the photosensitive drum 1 by a cleaning device 6 as a cleaning means. Further, deposited matters such as toner (secondary transfer residual toner) remaining on the intermediary transfer belt 7 after the secondary transfer, and paper powder guided from the recording material P are removed and collected from the surface of the intermediary transfer belt 7 by a belt cleaning device 12 as an intermediary member cleaning means. In this embodiment, the belt cleaning device 12 electrostatically collects and removes the deposited matters such as the secondary transfer residual toner or the like on the intermediary transfer belt 7.

Incidentally, in this embodiment, an intermediary transfer belt unit 20 as a belt feeding device is constituted by including the intermediary transfer belt 7 stretched by the plurality of stretching rollers, the respective primary transfer rollers 5, the belt cleaning device 12, a frame supporting these members, and the like. The intermediary transfer belt unit 20 is mountable to and dismountable from the apparatus main assembly 110 for maintenance and exchange.

Here, as the intermediary transfer belt 7, a belt constituted by a resin-based material formed in a single layer structure or a multi-layer structure including an elastic layer constituted by an elastic material can be used.

Further, in this embodiment, the primary transfer roller 5 is constituted by providing an elastic layer formed with an ion-conductive foam rubber on an outer peripheral surface of a core metal (core material) made of metal. Further, in this embodiment, the primary transfer roller 5 is 15-20 mm in outer diameter and is $1\times10^5$ to $1\times10^8\Omega$ in electric resistance value in the case where the electric resistance is measured under application of a voltage of 2 kV in an environment of 23° C. and 50% RH.

Further, in this embodiment, the outer roller 9 is constituted by providing an elastic layer formed with an ion-conductive foam rubber on an outer peripheral surface of a core metal (core material) made of metal. Further, in this embodiment, the outer roller 9 is 20-25 mm in outer diameter and is $1\times10^5$ to $1\times10^8\Omega$ in electric resistance value in the case where the electric resistance is measured under application of a voltage of 2 kV in an environment of 23° C. and 50% RH. Further, in this embodiment, the outer roller 9 is rotatably supported by bearings 9*a* (FIG. 2) at opposite end portions thereof with respect to a rotational axis direction. The bearings 9*a* are slidable (movable) in a direction toward and away from the inner roller 21 and are pressed toward the inner roller 21 by urging spring 9*b* (FIG. 2) constituted by compression springs which are urging members (elastic members) as urging means. By this, the outer roller 9 contacts the intermediary transfer belt 7 toward the inner roller 21 at predetermined pressure and forms the secondary transfer nip N2. Further, in this embodiment, the inner roller 21 is constituted by providing an elastic layer formed with an electroconductive rubber on an outer peripheral surface of a core metal (core material) made of metal. Further, in this embodiment, the inner roller 21 is 20-22 mm in outer diameter and is $1\times10^5$-$1\times10^8\Omega$ in electric resistance value in the case where the electric resistance value is measured under application of a voltage of 50 V in an environment of 23° C. and 50% RH. Incidentally, the pre-secondary transfer roller 24 may also have the same constitution as the constitution of the inner roller 24, for example.

Further, in this embodiment, rotational axis directions of the stretching rollers including the inner roller 21 for the intermediary transfer belt 7 and the outer roller 9 are substantially parallel to each other.

2. Offset Amount

Part (a) of FIG. 10 is a schematic sectional view (cross-section substantially perpendicular to the rotational axis direction of the inner roller 21) for illustrating behavior of the recording material P in the neighborhood of the secondary transfer nip N2.

As described above, depending on the position (shape) of the secondary transfer nip N2 and the rigidity of the recording material P, the behavior of the recording material P in the neighborhood of the upstream side and the downstream side of the secondary transfer nip N2 with respect to the feeding direction of the recording material P changes. Further, for example, in the case where the recording material P is "thin paper" which is an example of a recording material with low rigidity, a jam (paper jam) occurs in some instances due to the "improper separation" of the recording material P from the intermediary transfer belt 7. This phenomenon becomes noticeable in the case where the rigidity of the recording material P is small since the recording material P is liable to stick to the intermediary transfer belt 7 due to weak stiffness of the recording material P.

That is, in the cross-section shown in part (a) of FIG. 10, a line showing the stretched surface of the intermediary transfer belt 7 formed by being stretched by the inner roller 21 and the pre-secondary transfer roller 24 is a stretched line T. Incidentally, the pre-secondary transfer roller 24 is an example of an upstream roller, of the plurality of stretching rollers, disposed upstream of and adjacent to the inner roller 21 with respect to the rotational direction of the intermediary transfer belt 7. Further, in the same cross-section, a rectilinear line passing through a rotation center of the inner roller 21 and a rotation center of the outer roller 9 is referred to as a nip center line Lc. Further, in the same cross-section, a line substantially perpendicular to the nip center line Lc is referred to as a nip line Ln. Incidentally, part (a) of FIG. 10 shows a state in which with respect to a direction along the stretched line T, the rotation center of the outer roller 9 is offset to a side upstream of the rotation center of the inner roller 21 with respect to the rotational direction of the intermediary transfer belt 7.

At this time, in a state in which the recording material P is nipped between the inner roller 21 and the outer roller 9 in the secondary transfer nip N2, there is a tendency that the recording material P tries to hold an attitude thereof substantially along the nip line Ln. For that reason, roughly, in the case where with respect to the direction along the stretched line T, the rotation center of the inner roller 21 and the rotation center of the outer roller 9 are close to each other, as indicated by a broken line A in part (a) of FIG. 10, a discharge angle θ of the recording material P becomes small. That is, the leading end of the recording material P with respect to the feeding direction assumes an attitude such that the leading end is discharged close to the intermediary transfer belt 7 when the recording material P is discharged from the secondary transfer nip N2. By this, the recording material P is liable to stick to the intermediary transfer belt 7, so that the "improper separation" of the recording material P from the intermediary transfer belt 7 is liable to occur. On the other hand, roughly, as indicated by a solid line in part (a) of FIG. 10, the discharge angle θ of the recording material P becomes large with respect to the direction along the stretched line T, and the rotation center of the outer roller 9 is disposed on the side upstream of the rotation center of the inner roller 21 with respect to the rotational direction of the intermediary transfer belt 7. That is, the leading end of the recording material P assumes an attitude such that when the recording material P is discharged from the secondary transfer nip N2, the leading end is discharged in a direction in which the leading end is moved away from the intermediary transfer belt 7. By this, the recording material P does not readily stick to the intermediary transfer belt 7, so that the "separation property" of the recording material P from the intermediary transfer belt 7 is improved.

On the other hand, for example, in the case where the recording material P is "thick paper" which is an example of the recording material P with high rigidity, when a trailing end of the recording material P with respect to the feeding direction passes through the feeding guide 14, a trailing end portion of the recording material P with respect to the feeding direction collides against the intermediary transfer belt 7 in some instances. By this, image defect (by "jumping-up") occurs in some instances at the trailing end portion of the recording material P with respect to the feeding direction. This phenomenon becomes noticeable in the case where the rigidity of the recording material P is high since the trailing end portion of the recording material P with respect to the feeding direction is liable to collide violently against the intermediary transfer belt 7 due to strong stiffness of the recording material P. Further, for example, in the case of the "thick paper", on a side upstream of the secondary transfer nip N2 with respect to the feeding direction of the recording material P, a rubbing (frictional) force between the recording material P and the intermediary transfer belt 7 is large, so that image defect due to this rubbing (friction) is liable to occur.

That is, as described above, in the cross-section shown in part (a) of FIG. 10, in a state in which the recording material P is nipped between the inner roller 21 and the outer roller 9 in the secondary transfer nip N2, the recording material P tries to hold an attitude thereof substantially along the nip line Ln. For that reason, generally, the nip line Ln has a shape such that the nip line Ln bites into the stretched line T with respect to the direction along the stretched line T, and the rotation center of the outer roller 9 is disposed on the side upstream of the rotation center of the inner roller 21 with respect to the rotational direction of the intermediary transfer belt 7. As a result, when the trailing end of the recording material P passes through the feeding guide 14, as indicated by a broken line B in part (a) of FIG. 10, the trailing end portion of the recording material P with respect to the feeding direction collides against the intermediary transfer belt 7, so that the image defect (by the "jumping-up") is liable to occur at the trailing end portion of the recording material P. On the other hand, generally, with respect to the direction along the stretched line T, the rotation center of the inner roller 21 and the rotation center of the outer roller 9 are brought near to each other, and when the trailing end of the recording material P with respect to the feeding direction passes through the feeding guide 15, collision of the trailing end of the recording material P against the intermediary transfer belt 7 is suppressed. By this, the image defect (by the "jumping-up" at the trailing end portion of the recording material P with respect to the feeding direction does not readily occur.

As countermeasures against such a problem, depending on the kind of the recording material P, a change in relative position between the inner roller 21 and the controller 9 with respect to a circumferential direction (rotational direction of the intermediary transfer belt 7) is effective.

FIG. 11 is a schematic sectional view (cross-section substantially perpendicular to the rotational axis direction of the inner roller 21) of a portion in the neighborhood of the secondary transfer nip N2, for illustrating definition of an offset amount X indicating the relative position between the inner roller 21 and the outer roller 9.

In the cross-section shown in FIG. 11, a common tangential line of the inner roller 21 and the pre-secondary transfer roller 24 on a side where the intermediary transfer belt 7 is extended around the stretching rollers is a reference line L1. The reference line L1 corresponds to the stretched line T. Further, in the same cross section, a rectilinear line which passes through the rotation center of the inner roller 21 and which is substantially perpendicular to the reference line L1 is referred to as an inner roller center line L2. Further, in the same cross section, a rectilinear line which passes through the rotation center of the outer roller 9 and which is substantially perpendicular to the reference line L1 is referred to as an outer roller center line L3. At this time, a distance (vertical distance) between the inner roller center line L2 and the outer roller center line L3 is the offset amount X (in this case, the offset amount X is a positive value when the outer roller center line L3 is on the side upstream of the inner roller center line L2 with respect to the rotational direction of the intermediary transfer belt 7). The offset amount X can be a negative value, zero and the positive value. By making the offset amount X large, a width of the secondary transfer nip N2 with respect to the rotational direction of the intermediary transfer belt 7 extends toward an upstream side of the rotational direction of the intermediary transfer belt 7. That is, with respect to the rotational direction of the intermediary transfer belt 7, an upstream end portion of a contact region between the outer roller 9 and the intermediary transfer belt 7 is positioned further on an upstream side than an upstream end portion of a contact region between the inner roller 21 and the intermediary transfer belt 7 is. Thus, by changing a position of at least one of the inner roller 21 and the outer roller 9, the relative position between the inner roller 21 and the outer roller 9 with respect to the circumferential direction of the inner roller 21 is changed, so that the position of the secondary transfer nip (transfer portion) N2 can be changed.

In FIG. 11, the outer roller 9 is illustrated so as to contact the reference line L1 (stretched line T) without being deformed virtually with respect to the reference line L1. However, as described above, a material of an outermost layer of the outer roller 9 is an elastic member such as a rubber or a sponge, and in actuality, the outer roller 9 is urged and deformed by the urging spring 9*b* in a direction (a white arrow direction) toward the inner roller 21. When the outer roller 9 is offset and disposed on a side upstream of the inner roller 21 with respect to the rotational direction of the intermediary transfer belt 7 and then is urged by the urging spring 9*b* so as to nip the intermediary transfer belt 7 between itself and the inner roller 21, the secondary transfer nip N2 having a substantially S-shape is formed. Further, an attitude of the recording material P guided and sent by the feeding guide 14 is also determined by following the shape of the secondary transfer nip N2. With an increasing offset amount X, the recording material P is bent in a larger degree. For that reason, as described above, for example, in the case where the recording material P is the "thin paper", by increasing the offset amount X, it is possible to improve the separation property of the recording material P from the intermediary transfer belt 7 after the recording material P passes through the secondary transfer nip N2. However, when the offset amount X is large, as described above, for example, in the case where the recording material P is the "thick paper", the trailing end portion of the recording material P with respect to the feeding direction collides against the intermediary transfer belt 7 when the trailing end of the recording material P with respect to the feeding direction passes through the feeding guides 14. By this, the collision causes a lowering in image quality at the trailing end portion of the recording material P with respect to the feeding direction. For that reason, in this case, the offset amount X may only be required to be made small.

3. Offset Mechanism

With reference to parts (a) and (b) of FIG. 2, an offset mechanism 17 in this embodiment will be described. Parts (a) and (b) of FIG. 2 are schematic side views, for illustrating the offset mechanism 17, of a principal part of a portion in the neighborhood of the secondary transfer nip N2 in this embodiment as seen from one end portion side (front side on the drawing sheet of FIG. 1) with respect to a rotational axis direction of the inner roller 21 in a direction substantially perpendicular to the rotational axis direction. Part (a) of FIG. 2 shows a state in which the offset amount X is relatively small, and part (b) of FIG. 2 shows a state in which the offset amount X is relatively large. In parts (a) and (b) of FIG. 2, a structure at the one end portion with respect to the rotational axis direction of the inner roller 21 is shown, but a structure at the other end portion is similar thereto (i.e., is substantially symmetrical therewith with respect to a center with respect to the rotational axis direction of the inner roller 21).

As shown in parts (a) and (b) of FIG. 2, in this embodiment, the image forming apparatus 100 includes the offset mechanism 17 as a position changing mechanism for changing the offset amount X (position of the secondary transfer nip N2) by changing a relative position of the inner roller 21 to the outer roller 9 with respect to the circumferential direction.

Opposite end portions of the inner roller 21 with respect to the rotational axis direction are rotatably supported by an inner roller holder 38. The inner roller holder 38 is supported by a frame or the like of the intermediary transfer belt unit 20 so as to be rotatable about an inner roller rotation shaft 38*a*. Thus, the inner roller holder 38 is rotated about the inner roller rotation shaft 38*a*, and thus the inner roller 21 is rotated about the inner roller rotation shaft 38*a*, so that the relative position of the inner roller 21 to the outer roller 9 is changed, and thus the offset amount X can be changed.

The inner roller holder 38 is constituted so as to be rotated by the action of an offset cam 39. The offset cam 39 is supported by the frame or the like of the intermediary transfer belt unit 20 so as to be rotatable about an offset cam rotation shaft 39*a*. The offset cam 39 is rotated about the offset cam rotation shaft 39*a* by receiving drive from an offset cam driving motor 213 as a driving source. Further, the offset cam 39 contacts a cam follower 38*b* provided as a part of the inner roller holder 38. Further, the inner roller holder 38 may be urged by a rotation spring constituted by a tensile spring or the like which is another urging member (elastic member) as another urging means so that the cam follower 38*b* engages with the offset cam 39. Incidentally, by the tension of the intermediary transfer belt 7 or urging by the outer roller 9, moment enough to rotate the inner roller holder 38 in a direction in which the cam follower 38*b* engages with the offset cam 39 is obtained in some instances. In this case, the above-described rotation spring does not have to be provided. In this embodiment, the image forming apparatus 100 is provided with an offset cam position sensor (cam HP sensor) 214 as a position detecting means for detecting a position of the offset cam 39 with respect to the rotational direction, particularly a home position (HP) with respect to the rotational direction. The offset cam position sensor 214 can be constituted by, for example, a flag as an indicating portion provided on or coaxially with the offset cam 39 and a photo-interrupter as a detecting portion.

Thus, in this embodiment, the offset mechanism 17 is constituted by including the inner roller holder 38, the offset cam 39, the offset cam driving motor 213, the offset cam position sensor 214, and the like.

As shown in part (a) of FIG. 2, in the case where the offset amount X is to be made relatively small, the offset cam 39 is rotated clockwise by being driven by the offset cam driving motor 213. By this, the inner roller holder 38 is rotated counterclockwise about the inner roller rotation shaft 38*a*, so that the relative position of the inner roller 21 to the outer roller 9 is determined. By this, a state in which the inner roller 21 is disposed at a position where the offset amount X is relatively small is formed. By this, for example, it becomes effective that a lowering in image quality due to the rubbing (friction) between the recording material P and the intermediary transfer belt 7 and a lowering in image quality of a trailing end portion of the recording material P on the side upstream of the secondary transfer nip N2 with respect to the feeding direction of the recording material P are suppressed.

Further, as shown in part (b) of FIG. 2, in the case where the offset amount X is to be made relatively large, the offset cam 39 is rotated counterclockwise by being driven by the offset cam driving motor 213. By this, the offset cam holder 38 is rotated clockwise about the inner roller rotation shaft 38*a*, so that the relative position of the inner roller 21 to the outer roller 9 is determined. By this, a state in which the inner roller 21 is disposed at a position where the offset amount X is relatively large is formed. By this, it becomes effective that a separation property of the recording material P from the intermediary transfer belt 7 after the recording material P passes through the secondary transfer nip N2 is improved.

Incidentally, the offset amount X may only be required to be a predetermined value when the recording material P passes through the secondary transfer nip N2 (during the secondary transfer).

4. Control Mode

FIG. 3 is a schematic block diagram showing a control mode of a principal part of the image forming apparatus 100 in this embodiment. The image forming apparatus 100 includes the controller (control circuit) 200 as a control means. The controller 200 is constituted by including a CPU 201 as a calculation control means which is a dominant element for performing processing, memories (storing media) such as a RAM 210 and a ROM 220, which are used as storing means, and an unshown interface portion (input/output circuit) and the like. In the RAM, which is rewritable memory, information inputted to the controller 200, detected information, a calculation result and the like are stored. In the ROM, a data table acquired in advance and the like are stored. The CPU 201 and the memories such as the RAM 210 and the ROM 220 are capable of transferring and reading the data therebetween. The interface portion controls input and output (communication) of signals between the controller 200 and devices connected to the controller 200.

To the controller 200, respective portions (the image forming portions 10, the intermediary transfer belt 7, driving devices for the members relating to feeding of the recording material P, various voltage sources and the like) of the image forming apparatus 100 are connected. To the controller 210, driving means for driving respective portions of the image forming apparatus 100, such as an offset cam driving motor 213, a drum driving motor, a belt driving motor, and the like motor are connected. In the controller 200, on the basis of information stored in the RAM 210 and the ROM 220, the CPU 201 operates the driving means for driving the respective portions of the image forming apparatus 100, such as the offset cam driving motor 213 and the like. Further, to the controller 200, the operating portion (operating panel) 101 provided on the image forming apparatus 100 is connected. The operating portion 101 includes a display portion (display means) for displaying information by control of the controller 200 and an input portion (input means) for inputting information to the controller 200 through an operation by an operator such as a user or a service person. The operating portion 101 may be constituted by including a touch panel having functions of the display portion and the input portion. Further, to the controller 200, an image reading apparatus (not shown) provided in or connected to the image forming apparatus and an external device (not shown) such as a personal computer connected to the image forming apparatus 100 may also be connected.

The controller 200 causes the image forming apparatus 100 to perform the image forming operation by controlling the respective portions of the image forming apparatus 100 on the basis of information on a job. The job information includes a start instruction (start signal) and information (instruction signal) on an image formation condition such as a kind of the recording material P, which are inputted from the operating portion 101 or the external device. Further, the job information includes image information (image signals) inputted from the external device or the operating portion 101. Incidentally, information on the kind of the recording material encompasses arbitrary pieces of information capable of discriminating the recording material P, inclusive of attributes (so-called sheet categories) based on general features such as plain paper, quality paper, coated paper, embossed paper, thick paper and thin paper, numerals and numerical ranges such as a basis weight, a thickness, a size and rigidity, and brands (including manufacturers, product numbers and the like).

Here, the image forming apparatus 100 executes a job (printing job, print job) which is a series of operations which is started by a single start instruction and in which the image is formed and outputted on a single recording material P or a plurality of recording materials P. The job includes an image forming step (image forming operation, printing operation, print operation), a pre-rotation step, a sheet (paper) interval step in the case where the images are formed on the plurality of recording materials P, and a post-rotation step in general. The image forming step is performed in a period in which formation of an electrostatic image for the image actually formed and outputted on the recording material P, formation of the toner image, primary transfer of the toner image and secondary transfer of the toner image are carried out. Specifically, timing during the image formation is different among positions where the respective steps of the formation of the electrostatic image, the toner image formation, the primary transfer of the toner image and the secondary transfer of the toner image are performed. The pre-rotation step is performed in a period of a preparatory operation, before the image forming step, from an input of the start instruction until the image is started to be actually formed. The sheet interval step is performed in a period corresponding to an interval between a recording material P and a subsequent recording material P when the images are continuously formed on a plurality of recording materials P (continuous image formation). The post-rotation step is performed in a period in which a post-operation (preparatory operation) after the image forming step is performed. During non-image formation (non-image formation period) is a period other than the period of the image formation and includes the periods of the pre-rotation step, the sheet interval step, the post-rotation step and further includes a period of a pre-multi-rotation step which is a preparatory operation during turning-on of a main switch (voltage source) of the image forming apparatus 100 or during restoration from a sleep state. Incidentally, the sleep state (rest state) is a state, for example, in which supply of electric power to the respective portions of the image forming apparatus 100, other than the controller 200 (or a part thereof), is stopped and electric power consumption is made smaller than electric power consumption in a stand-by state, a main switch of the image forming apparatus 100 is turned on and the image forming apparatus 100 stands by for the job. In this embodiment, during the non-image formation, typically in the stand-by state, the image forming apparatus 100 is capable of carrying out an operation for changing the offset amount X during non-image formation.

5. Change Control of Offset Amount

Next, control of changing the offset amount X in this embodiment will be described. In this embodiment, on the basis of information on a thickness of the recording material P which is an example of information on a kind of the recording material P relating to rigidity of the recording material P as the information on the kind of the recording material P, the image forming apparatus 100 is capable of executing control of changing the offset amount X.

FIG. 4 is a flowchart showing an outline of a procedure of control of the change in offset amount X in this embodiment. In this embodiment, the case where in the operating portion 101, the operator inputs the information on the kind of the recording material P used in image formation, and then on the basis of this information, the controller 200 executes the control of the change in offset amount X will be described.

First, the CPU 201 acquires job information inputted by the outer roller or through the operating portion 101 and stores the job information in the RAM 210 (S1). The job information includes the information on the kind of the recording material P subjected to the image formation and information on the number of sheets to be printed. Then, the CPU 201 acquires the information on the thickness of the recording material P and the information on the surface property of the recording material P from the information on the kind of the recording material P subjected to the image formation included in the job information acquired in S1 (S2).

In this embodiment, as the information on the thickness of the recording material P, information on a basis weight of the recording material P (in this embodiment, this basis weight is also referred to as a "sheet basis weight") is inputted (including selection from a plurality of choices) by the outer roller or through the operating portion 101. Further, in this embodiment, as the information on the surface property of the recording material P, so-called sheet category information is inputted (including selection from a plurality of choices) by the operator through the operating portion 101. Here, the sheet category information refers to information on the kind of the recording material P for discriminating attributes based on general features of the recording material P, such as high-quality paper, recycled paper, matt coated paper, and gloss coated paper. In this embodiment, the recording material P in the sheet category, such as high-quality paper or recycled paper, of which surface is not subjected to any coating is referred to as a rough surface recording material P (also referred to as "non-coated paper"). Further, in this embodiment, the recording material P in the sheet category, such as the matt coated paper or the gloss coated paper, of which surface is subjected to some coating is referred to as a recording material P having a smooth surface property (also referred to as "coated paper").

Further, the image forming apparatus 100 of this embodiment is capable of executing a mixed job in which images are formed on recording materials of a plurality of kinds. Accordingly, the kind of the recording material P selectable through the operating portion 101 in a single job is not limited to a single kind. Incidentally, in the mixed job, the recording materials P of the plurality of kinds accommodated in a plurality of recording material cassettes 11 (omitted from illustration in FIG. 1), respectively, provided in the image forming apparatus 100 are appropriately fed in a designated order.

On the basis of information acquired in S2, the CPU 201 acquires an offset amount X suitable for the recording material P subsequently subjected to the image formation (S3). In this embodiment, an offset amount table which is information showing a relationship of a sheet basis weight and a surface property, which are set in advance, with the offset amount X is stored in the ROM 220. The CPU 201 acquires the offset amount X suitable for an associated recording material P by making reference to this offset amount table. A table 1 schematically shows the offset amount table in this embodiment.

TABLE 1

| SHEET | SBW*1 (g/cm²) | | | | |
|---|---|---|---|---|---|
| CATEGORY | ≤220 | 221-256 | 257-300 | 301-325 | 326-350 |
| NCP*2 | OA:L | OA:L | OA:L | OA:L | OA:S |
| CP*3 | OA:L | OA:S | OA:S | OA:S | OA:S |

*1"SBW" is the sheet basis weight.
"OA:L" represents that the offset amount X is large.
"OA:S" represents that the offset amount X is small.
*2"NCP" is the non-coated paper.
*3"CP" is the coated paper.

The offset amount table in the table 1 is set in general so that the offset amount X becomes smaller with an increasing sheet basis weight of the recording material P and so that the offset amount X becomes smaller for a smaller basis weight in the case of the smooth surface coated paper than that in the case of the rough surface non-coated paper.

The recording material P having a large sheet basis weight and high rigidity has a large rubbing (frictional) force with the intermediary transfer belt 7 on a side upstream of the secondary transfer nip N2 with respect to the feeding direction of the recording material P, so that the image defect due to this rubbing (friction) is liable to occur. Particularly, the smooth surface recording material P such as the coated paper in this embodiment is liable to become large in contact area with the intermediary transfer belt 7 when compared with the recording material P of which surface is not smooth. For that reason, as regards such as a recording material P, when the recording material P is the rough surface recording material P such as the non-coated paper as in this embodiment, there is a possibility of an occurrence of the image defect even in the case of the sheet basis weight in which the image defect due to the above-described rubbing (friction). On the other hand, when the offset amount X is small, the discharging direction of the recording material P discharged from the secondary transfer nip N2 is liable to become a direction in which the recording material P approaches the intermediary transfer belt 7. For that reason, improper separation such that the recording material P having a small basis weight and low rigidity is electrostatically attracted to the intermediary transfer belt 7 is liable to occur. In view of these phenomena, the offset amount X is increased for the recording material P having the small sheet basis weight and is decreased for the recording material P having the large sheet basis weight.

In this embodiment, the offset amount X in the case of "OA:S" in the offset amount table of the table 1 was set at about −0.5 to −2.5 mm. Further, in this embodiment, the offset amount X in the case of "OA:L" in the offset amount table of the table 1 was set at about 2 to 4 mm. Incidentally, in sections of the respective sheet basis weights in the table 1, the offset amounts X may be the same (for example, OA:L=+2.5 mm, OA:S=−1.3 mm) and may also be different from each other so that the offset amount X becomes larger with a smaller sheet basis weight (or so that the offset amount X becomes smaller with a larger sheet basis weight).

Incidentally, setting of the offset amount X is not limited to the above-described specific examples. These values can be appropriately set through an experiment or the like from viewpoints of the improvement in separation property of the recording material P from the intermediary transfer belt 7 and the suppression of the image defect occurring in the neighborhood of the secondary transfer nip N2 which are as described above. Further, a change in offset amount X (the position of the inner roller 21) is not limited to the two levels. The offset amount X (the position of the inner roller 21) may also be changeable to three or more levels or continuously. Further, in this embodiment, the surface property of the recording material P is classified into the two kinds but may also be classified into three or more kinds.

Further, in this embodiment, as regards the recording materials P with sheet basis weights of about 100 g/m² which are high in use frequency in general as actual results in the field, there is a possibility of the occurrence of the improper separation, and therefore, the offset amount table is set so that the offset amount X is the "OA:L". Further, in this embodiment, a position where the offset amount X is the "OA:L" is used as a home position of the inner roller 21 (relative position between the inner roller 21 and the outer roller 9). Here, the home position refers to a position when the image forming apparatus 100 is in a sleep state or in a state in which the main switch thereof is turned off. Accordingly, at timing when the job is started, the offset amount X is set at the "OA:L".

Here, after the job (mixed job) is started, when control of changing the offset amount X is carried out many times, productivity of the job lowers. For that reason, as regards the rough surface recording material P (non-coated paper) low in risk of the image defect due to the above-described rubbing, recording materials P with a wide range of the sheet basis weight are kept at a state of the "OA:L" corresponding to the home position of the inner roller 21, while as regards the smooth surface recording material P (coated paper) high in risk of the image defect due to the rubbing, the offset amount X for the recording material P with the sheet basis weight smaller than the sheet basis weight of the above-described rough surface recording material P (non-coated paper) is switched to the "OA:S". By this, both the productivity and the image quality in the job (mixed job) are easily realized.

In other words, in this embodiment, between the rough surface recording material P (non-coated paper) and the smooth surface recording material P (coated paper), a threshold (predetermined value) of the sheet basis weight for switching the offset amount X between the "OA:L" and the "OA:S" is changed. In this embodiment, the threshold is smaller in the case of the smooth surface recording material (coated paper) than in the case of the rough surface recording material (non-coated paper). For example, as shown in the table 1, as regards the rough surface recording material P (non-coated paper), the offset amount X is set at the "OA:L" in the case where the sheet basis weight is 325 g/m² or less and is set at the "OA:S" in the case where the sheet basis weight is larger than 325 g/m². On the other hand, as regards the smooth surface recording material P (coated paper), the offset amount X is set at the "OA:L" in the case where the sheet basis weight is 220 g/m² or less and is set at the "OA:S" in the case where the sheet basis weight is larger than 220 g/m².

At timing when the job is started in the offset amount X acquired in S3, the CPU 201 discriminates whether or not there is a need to change the offset amount X which is the "OA:L" (S4). In the case where the CPU 201 discriminated in S4 that there is no need to change the offset amount X, the CPU 201 carries out the image formation on the recording material P by the above-described image forming process (S5). On the other hand, in the case where the CPU 201 discriminated in S4 that there is a need to change the offset amount X, the CPU 201 causes the offset cam driving motor 213 to operate only in a predetermined amount, so that the offset amount X is changed to the offset amount X acquired in S3 (S6). At this time, the CPU 201 acquires information on a current position of the offset cam 39 from the offset cam position sensor 214 detecting the position of the offset cam 39. Then, on the basis of the information on this position, the CPU 201 acquires an operation amount of the offset cam driving motor 213 necessary to provide a predetermined offset amount X by making reference to a cam drive amount conversion table stored in the ROM 220. The cam drive amount conversion table is, for example, constituted so as to show a relationship between the operation amount (angle of rotation of the offset cam 39) of the offset cam driving motor 213 and the offset amount X which are based on the home position of the offset cam 39. Thereafter, the CPU 201 carries out the image formation on the recording material P by the above-described image forming process (S5).

After the image formation on the recording material P is ended in S5, the CPU 201 discriminates whether or not all the image forming operations in the job are ended (S7). In the case where the CPU 201 discriminated in S7 that all the image forming operations in the job are ended, the CPU 201 causes the offset cam driving motor 213 to operate so that the offset amount X becomes the "OA:L" corresponding to the home position of the inner roller 21, and then ends the control. That is, at this time, the CPU 201 causes the offset cam driving motor 213 to operate so that the position of the offset cam 39 becomes the home position.

On the other hand, in the case where the CPU 201 discriminated in S7 that all the image forming operations are not ended, the CPU 201 discriminates whether or not the recording material P is a recording material P different in kind from the recording material P subjected to the last image formation (S9). In the case where the CPU 201 discriminated in S9 that the recording material P is not the recording material P different in kind from the above-described recording material P but is the same kind recording material P as the above-described recording material P, the sequence returns to S5, and the image formation on the recording material P is carried out. Further, in the case where the CPU 201 discriminated in S9 that the recording material P is the recording material P of the different kind, the sequence returns to S2, and then the processes after the process of acquiring the offset amount are performed.

6. Effect

As described above, the image forming apparatus 100 of this embodiment includes the position changing mechanism 17 capable of changing the relative position between the inner roller 21 and the outer member 9 with respect to the circumferential direction of the inner roller 21 by changing the position of at least one (the inner roller 21 in this embodiment) of the inner roller 21 and the outer member 9, the controller 200 for controlling the position changing mechanism 17, and the input portion for permitting input of first information on the thickness of the recording material P and second information on the surface property of the recording material P. Then, in this embodiment, the controller 200 is capable of controlling the position changing mechanism 17 so that the above-described relative position when the job image is transferred onto the recording material P for which the thickness indicated by the first information is larger than the predetermined value is the first relative position and so that the above-described relative position when the toner image is transferred onto the recording material P for which the thickness indicated by the first information is the predetermined value or less is the second relative position where the inner roller 21 is positioned further downstream of the outer member 9 with respect to the rotational direction of the intermediary transfer belt 7 than that at the first relative position, and is capable of changing the above-described predetermined value so as to be smaller in the case where the toner image is transferred onto the recording material P having the second surface property, indicated by the second information, smoother than the first surface property indicated by the second information than that in the case where the toner image is transferred onto the recording material P having the first surface property indicated by the second information. In this embodiment, the first information is information on the basis weight the recording material P. Further, in this embodiment, the input portion permits input, to the controller 200, of the information through the operating portion 101 which is provided on the image forming apparatus 100 and which is operated by the operator. However, as described later, the input portion may also be one for permitting input, to the controller 200, of information from the detecting at least one of an index value on the thickness of the recording material P and an index value on the surface property of the recording material P.

Thus, in this embodiment, the image forming apparatus 100 carries out the control of changing the offset amount X in order to compatibly realize the suppression of the image defect liable to occur in the case of the recording material P such as the thick paper with high rigidity and suppression of the improper separation liable to occur in the case of the recording material P such as the thin paper with low rigidity. The image defect liable to occur in the case of the recording material P such as the thick paper with high rigidity includes the image defect liable to occur due to the rubbing between the recording material P and the intermediary transfer belt 7, the image defect liable to occur before and after the recording material passes through the feeding guide 14, and the like image defect. At this time, in this embodiment, the image forming apparatus 100 carries out the control of changing the offset amount X on the basis of the information on the basis weight of the recording material P and the information on the surface property of the recording material P. Thus, in this embodiment, the control of changing the offset amount X is carried out on the basis of not only the information (the information on the basis weight of the recording material in this embodiment) on the thickness of the recording material P, which is an example of the information on the rigidity of the recording material P, but also the information on the surface property of the recording material P. By this, the operation of changing the offset amount X can be performed depending on the surface property of the recording material P only when there is possibility of an occurrence of a problem of image quality.

In this embodiment, as the information on the thickness of the recording material P, the sheet basis weight inputted through the operating portion 101 was acquired, but the present invention is not limited to such an embodiment. For example, it is also possible to carry out control on the basis of the information on the thickness of the recording material P detected by a detecting means, for detecting the thickness of the recording material P, provided in the image forming apparatus 100. For example, as the detecting means for detecting an index value correlating with the basis weight and the thickness of the recording material P, a basis weight sensor utilizing attenuation of ultrasonic wave has been known. This sensor includes an ultrasonic generating portion and an ultrasonic receiving portion which are provided so as to sandwich a recording material feeding passage. This sensor generates the ultrasonic wave from the ultrasonic generating portion and receives the ultrasonic wave attenuation by being passed through the recording material P, and then on the basis of attenuation amount of the ultrasonic wave, detects the index value correlating with the basis weight and the thickness of the recording material P. Incidentally, when the sensor is capable of detecting the index value correlating with the basis weight and the thickness of the recording material P, the sensor is not limited to the detecting means utilizing the ultrasonic wave, but a sensor utilizing light can be used, for example.

Further, in this embodiment, as the information on the surface property of the recording material P, the information on the sheet category inputted through the operating portion 101 was acquired, but the present invention is not limited to such an embodiment. For example, numeral information on surface roughness of the recording material P is made inputtable, so that control based on the acquired numerical information on the surface roughness can also be carried out. For example, as the detecting means for detecting the index value correlating with the surface property of the recording material P, a regularly/irregularly reflected light sensor for reading intensity of regularly reflected light and irregularly reflected light by irradiating the recording material P with light has been known. When the surface of the recording material P is smooth, the regularly reflected light becomes strong, and in the case where the surface of the recording material is rough, the irregularly reflected light becomes strong. For that reason, this sensor is capable of detecting the index value corresponding with the smoothness of the recording material surface by measuring a regularly reflected light quantity and an irregularly reflected light quantity. Incidentally, when this sensor may only be required to be capable of detecting the index value correlating with the smoothness of the recording material surface, the sensor is not limited to the above-described sensor utilizing the light quantity sensor, but a sensor utilizing, for example, an image-pick up element can also be used. The index correlating the smoothness of the recording material surface is not limited to a value converted to a value in conformity to a predetermined standard such as Bekk smoothness, but may only be required to be a value having a correlation with the smoothness of the recording material surface. The above-described detecting means for detecting the thickness and the surface property of the recording material P can be disposed adjacent to the recording material feeding passage on a side upstream of the registration rollers 8 with respect to the recording material feeding direction, for example. Further, for example, the detecting means for detecting the thickness and the surface property may also use a sensor (media sensor) constituted as a single unit.

Further, as in this embodiment, in the case where the information (information on the thickness and the surface property) on the kind of the recording material P is inputted through the operating portion 101, the input is not limited to direct input (including selection from a plurality of choices) of the information on the kind of the recording material P. For example, a predetermined recording material cassette 11 is selected from the plurality of recording material cassettes 11, so that the information on the kind of the recording material P, accommodated in the recording material cassette 11, stored in the storing medium in association with the recording material cassette 11 in advance is inputted.

Further, the input of the information (information on the thickness and the surface property) on the kind of the recording material P is not limited to the input through the operating portion 101 of the image forming apparatus 100, but the information may also be inputted from the external device communicatably connected with the image forming apparatus 100. In this case, the above-described interface portion (input/output circuit) or the like functions as the input portion.

Embodiment 2

Next, another embodiment of the present invention will be described. In an image forming apparatus according to this embodiment, elements having functions or constitutions identical or corresponding to those of the image forming apparatus of the embodiment 1 are represented by the same numerals or symbols as those in the embodiment 1 and will be omitted from detailed description.

1. Structure of Image Forming Apparatus

FIG. 5 is a schematic sectional view of an image forming apparatus 100 of this embodiment. The image forming apparatus 100 of this embodiment has a structure similar to the structure of the image forming apparatus 100 of the embodiment 1 shown in FIG. 1. However, in this embodiment, on an inner peripheral surface side of the intermediary transfer belt 7, an urging (pressing) member 26 is provided upstream of the inner roller 21 and downstream of the pre-secondary transfer roller 24 with respect to the rotational direction of the intermediary transfer belt 7. The urging member 26 contacts an inner peripheral surface of the intermediary transfer belt 7 and is capable of urging (pressing) the intermediary transfer belt from the inner peripheral surface side toward an outer peripheral surface side. By this, the urging member 26 is capable of causing a stretched surface T (FIG. 6) of the intermediary transfer belt 7 formed between the inner roller 21 and the pre-secondary transfer roller 24 to project from the inner peripheral surface side toward the outer peripheral surface side of the intermediary transfer belt 7. The urging member 26 and an urging mechanism 16 (FIG. 6) for changing a position of this urging member 26 will be further described later.

2. Penetration

Part (b) of FIG. 10 is a schematic sectional view (cross-section substantially perpendicular to the rotational axis direction of the inner roller 21) for illustrating a feeding attitude of the recording material P in the neighborhood of the secondary transfer nip N2. Incidentally, part (b) of FIG. 10 shows a state in which with respect to the direction along the stretched line T, the rotation center of the inner roller 21 and the rotation center of the outer roller 9 are disposed at the substantially same position.

As described above, depending on the rigidity of the recording material P, the attitude of the recording material P fed from the feeding guide 14 to the secondary transfer nip N2 changes. Further, for example, in the case where the recording material P is the "thick paper", in the neighborhood of about the secondary transfer nip N2, a gap G is liable to be formed between the intermediary transfer belt 7 and the recording material P, so that "scattering" is liable to occur.

That is, in part (b) of FIG. 10, in the neighborhood of about the inlet of the secondary transfer nip N2 (in the neighborhood of the upstream portion of the inner roller 21 with respect to the rotational direction of the intermediary transfer belt 7), a distance in which the intermediary transfer belt 7 and the recording material P contact each other along is defined as a contact distance D. Specifically, the contact distance D is a distance between a contact start position between the inner roller 21 and the intermediary transfer belt 7 and a contact start position between the recording material P and the intermediary transfer belt 7. For example, in the case where the recording material P is the "thick paper", the rigidity of the recording material P is high, and therefore, the recording material P is not readily bent in the neighborhood of the secondary transfer nip N2, so that the contact distance D becomes small. For that reason, the gap G is formed between the intermediary transfer belt 7 and the recording material P, and electric discharge occurs in the gap G by the influence of a transfer electric field, so that the toner image scatters and thus the image defect ("scattering") occurs in some instances.

As countermeasures against such a problem, provision of the urging member 26 for urging the intermediary transfer belt 7 in contact with the inner peripheral surface of the intermediary transfer belt 7 in the neighborhood of the inlet of the secondary transfer nip N2 is effective.

The stretched surface T of the intermediary transfer belt 7 is projected outward by the urging member 26, whereby the contact distance D is increased, so that the gap G between the intermediary transfer belt 7 and the recording material P in the neighborhood of the inlet of the secondary transfer nip N2 can be reduced. By this, the "scattering" can be suppressed.

The penetration amount (urging amount) of the urging member 26 into (against) the intermediary transfer belt 7 will be described. The urging amount in which the urging member 26 is urged against the intermediary transfer belt 7 can be represented by the following penetration amount in which the urging member 26 penetrates into the intermediary transfer belt 7. This penetration amount is roughly an amount such that the urging member 26 causes the intermediary transfer belt 7 to project outward with respect to a stretched surface (stretching surface) T of the intermediary transfer belt 7 forward by stretching the intermediary transfer belt 7 by the inner roller 21 or the outer roller 9 and the pre-secondary transfer roller 24. The pre-secondary transfer roller 24 is an example of upstream rollers, of a plurality of stretching rollers, disposed adjacent to the inner roller 21 on a state upstream of the inner roller 21 with respect to the rotational direction of the intermediary transfer belt 7. This definition of the penetration amount specifically changes depending on the offset amount X showing a relative position between the inner roller 21 and the outer roller 9 with respect to a circumferential direction of the inner roller 21. The definition of the offset X is as described in the embodiment 1. Parts (a) and (b) of FIG. 12 are schematic sectional views (cross-section substantially perpendicular to the rotational axis direction of the inner roller 21) of the neighborhood of the secondary transfer nip N2, for illustrating definition of a penetration amount Y of the urging member 26 into the intermediary transfer belt 7. Incidentally, the definition of the penetration amount Y is different between the case where the offset amount X is the positive value and the case where the offset amount X is the negative value. This is because in general whether the stretched surface T of the intermediary transfer belt 7 in a state in which the intermediary transfer belt 7 is not urged by the urging member 26 is formed by the inner roller 21 and the pre-secondary transfer roller 24 or by the outer roller 9 and the pre-secondary transfer roller 24 changes depending on the offset amount X. Part (a) of FIG. 12 shows the case where the offset amount X is 0 or the negative value (particularly the negative value), and part (b) of FIG. 12 shows the case where the offset amount X is the positive value.

First, the case where the offset amount X is 0 or the negative value will be described. In the cross-section shown in part (a) of FIG. 12, the common tangential line of the inner roller 21 and the pre-secondary transfer roller 24 on the side where the intermediary transfer belt 7 is extended around the stretching rollers is the reference line L1. The reference line L1 corresponds to the above-described stretched line T of the intermediary transfer belt 7 in the case where the intermediary transfer belt 7 is not provided outward by the urging member 26. Further, in the same cross-section, a tangential line of the intermediary transfer belt 7 which is substantially parallel to the reference line L1 and which contacts the outer peripheral surface of the intermediary transfer belt 7 in a region where the urging member 26 contacts the intermediary transfer belt 7 is an urging portion tangential line L4. At this time, in the case where the offset amount X is 0 or the negative value, a distance (vertical distance) between the reference line L1 and the urging portion tangential line L4 is defined as the penetration amount Y of the urging member 26 into the intermediary transfer belt 7 (however, the penetration amount Y is the positive value when the urging portion tangential line L4 is further on the outer peripheral surface side of the intermediary transfer belt 7 than the reference line L1 is). This penetration amount Y can be 0 or the positive value.

Next, the case where the offset amount X is 0 or the positive value will be described. In the cross-section shown in part (b) of FIG. 12, the common tangential line of the outer roller 9 and the pre-secondary transfer roller 24 on the side where the intermediary transfer belt 7 is extended around the stretching rollers is the reference line L1'. Further, in the same cross-section, a tangential line of the intermediary transfer belt 7 which is substantially parallel to the reference line L1 and which contacts the outer peripheral surface of the intermediary transfer belt 7 in a region where the urging member 26 contacts the intermediary transfer belt 7 is an urging portion tangential line L4'. At this time, in the case where the offset amount X is 0 or the positive value, a distance (vertical distance) between the reference line L1' and the urging portion tangential line L4' is defined as the penetration amount Y of the urging member 26 into the intermediary transfer belt 7 (however, the penetration amount Y is the positive value when the urging portion tangential line L4 is further on the outer peripheral surface side of the intermediary transfer belt 7 than the reference line L1 is). This penetration amount Y can be 0 or the positive value.

3. Urging Member and Urging Mechanism

Next, the urging member 26 and the urging mechanism 19 for changing the position of this urging member 26 will be described. Parts (a) and (b) of FIG. 6 are schematic side views of a principal part of a portion in the neighborhood of the secondary transfer nip N2 in this embodiment as seen from a one end portion side (front side on the drawing sheet of FIG. 5) with respect to a rotational axis direction of the inner roller 21 in a direction substantially perpendicular to the rotational axis direction. Part (a) of FIG. 6 shows a state in which the urging member 26 urges the intermediary transfer belt 7 with a predetermined urging force, and part (b) of FIG. 6 shows a state in which the urging member 26 is spaced from the intermediary transfer belt 7. In parts (a) and (b) of FIG. 6, a structure at the one end portion with respect to the rotational axis direction of the inner roller 21 is shown, but a structure at the other end portion is similar thereto (i.e., is substantially symmetrical therewith with respect to a center with respect to the rotational axis direction of the inner roller 21).

In this embodiment, the image forming apparatus 100 includes a sheet-like urging member (back-up sheet) 26. The urging member 26 is capable of causing the intermediary transfer belt 7 to project outward by urging (pressing) the inner peripheral surface of the intermediary transfer belt 7 in the neighborhood of the secondary transfer nip T2. With respect to the rotational direction of the intermediary transfer belt 7, the urging member 26 is disposed upstream of the inner roller 21 and downstream of the pre-secondary transfer roller 24 so as to be contactable to the inner peripheral surface of the intermediary transfer belt 7. Particularly, in this embodiment, with respect to the feeding direction of the recording material P, the urging member 26 is disposed so as to be contactable to the inner peripheral surface of the intermediary transfer belt 7 at a position corresponding to a position of a feeding guide 14 (first guiding member 14*a*) provided upstream of the inner roller and downstream of a free end of the feeding guide 14 on a downstream side.

The urging member 26 can be formed with a resin material. As the resin material forming the urging member 26, polyester resin or the like such as PET resin can be used suitably. In this embodiment, the urging member 26 is constituted by a plate-like member which has a predetermined length with respect to each of a longitudinal direction substantially parallel to a widthwise direction of the intermediary transfer belt 7 (substantially perpendicular to a surface movement direction of the intermediary transfer belt 7) and a short-side direction substantially perpendicular to the longitudinal direction and which has a predetermined thickness. The length of the urging member 26 with respect to the longitudinal direction is equal to the length of the intermediary transfer belt 7 with respect to the widthwise direction. The urging member 26 includes a free end portion, which is one end portion (end portion on a downstream side of the rotational direction), contactable to the inner peripheral surface of the intermediary transfer belt 7 over a substantially full width of the intermediary transfer belt 7 and capable of urging the intermediary transfer belt 7. Further, as an example, the urging member 26 is about 0.4-0.6 mm in thickness.

Here, as the urging member 26, for example, a PET resin sheet adjusted in electric resistance to a medium resistance (for example, volume resistivity of $1\times10^5$-$1\times10^9$ Ω·cm) can be used. By this, it is possible to suppress that a current flows through the urging member 26, and it is possible to suppress that rotation of the intermediary transfer belt 7 is prevented due to attraction of the intermediary transfer belt 7 to the urging member 26 by static electricity (triboelectric charge) caused by friction between the urging member 26 and the intermediary transfer belt 7.

Incidentally, the urging member 26 is not limited to the sheet-like member made of the resin material. The urging member 26 may also be, for example, a sheet-like member constituted by a thin plate made of metal. Further, the urging member 26 is not limited to the sheet-like member. The urging member 26 may also be, for example, an elastic member (such as a pad-like elastic member) formed with a sponge, a rubber or the like. Further, the urging member 26 may also be, for example, a rigid member such as a rotatable roller made of resin, metal or the like. Further, the urging member 26 is not limited to one which is contacted to the intermediary transfer belt 7 by being disposed at a predetermined position as in this embodiment. For example, in the case where the rigid member such as the above-described rotatable roller is used as the urging member 26 or in the like case, the urging member 26 may also be urged toward the intermediary transfer belt 7 by a spring or the like as an urging means.

In this embodiment, the image forming apparatus 100 includes the urging mechanism 16 as a position changing mechanism. The urging mechanism 16 changes a position of the urging member 26 and thus changes at least one of a penetration amount (urging amount) of the urging member 26 into the intermediary transfer belt 7 and a state in which the urging member 26 is contacted to or spaced from the intermediary transfer belt 7 (changes this state in this embodiment). Incidentally, in this embodiment, for simplicity, a change in penetration amount (urging amount) of the urging member 26 into the intermediary transfer belt 7 is described as including a change in state in which the urging member 26 is contacted to or spaced from the intermediary transfer belt 7 in some instances.

The urging member 26 is supported by an urging member holder 28 as a supporting member. The urging member 26 is fixed to the urging member holding 28 over a substantially full width thereof with respect to the longitudinal direction at a fixed end portion thereof which is one end portion (an upstream end portion with respect to the rotational direction of the intermediary transfer belt 7) with respect to the short-side direction thereof. The urging member holder 28 is held by a frame or the like of the intermediary transfer belt unit 20 so as to be rotatable about an urging member rotation shaft 28*a*. Thus, the urging member holder 28 is rotated about the urging member rotation shaft 28*a*, and thus the urging member 26 is rotated about the urging member rotation shaft 28*a*, so that the position of the urging member 26 can be changed. By this, at least one of the penetration amount (urging amount) of the urging member 26 into the intermediary transfer belt 7 and the state in which the urging member 26 is contacted to or spaced from the intermediary transfer belt 7 (this state in this embodiment) can be changed.

The urging member holder 28 is constituted so as to be rotated by the action of an urging cam 27. The urging cam 27 is held by the frame or the like of the intermediary transfer belt unit 20 so as to be rotatable about an urging cam rotation shaft 27*a*. The urging cam 27 is rotated about the urging cam rotation shaft 27*a* by receiving drive from an urging cam driving motor 211 as a driving source. Further, the urging cam 27 contacts a cam follower 28*b* provided as a part of the urging member holder 28. Further, the urging member holder 28 is urged by a rotation spring 29 constituted by a tensile spring or the like which is another urging member (elastic member) as another urging means so that the cam follower 28*b* engages with the urging cam 27. In this embodiment, the image forming apparatus 100 is provided with an urging cam position sensor (cam HP sensor) 212 as a position detecting means for detecting a position of the urging cam 27 with respect to the rotational direction, particularly a home position (HP) with respect to the rotational direction. The urging cam position sensor 212 can be constituted by, for example, a flag as an indicating portion provided on or coaxially with the urging cam 27 and a photo-interrupter as a detecting portion.

Thus, in this embodiment, the urging mechanism 16 is constituted by including the urging member holder 28, the urging cam 27, the urging cam driving motor 211, the urging cam position sensor 212, the rotation spring 29, and the like.

As shown in part (a) of FIG. 6, when the intermediary transfer belt 7 is urged by the urging member 26, the urging cam 27 is rotated clockwise by being driven by the urging member driving motor 211. By this, the urging member holder 28 is rotated counterclockwise about the urging member rotation shaft 28*a*, so that a state in which the urging member 26 is disposed at a position where the penetration amount of the urging member 26 into the intermediary transfer belt 7 is predetermined penetration amount is formed. At this time, a free end of the urging member 26 contacts the inner peripheral surface of the intermediary transfer belt 7 and causes the intermediary transfer belt 7 to project outward.

Further, as shown in part (b) of FIG. 6, when the urging member 26 is spaced from the intermediary transfer belt 7, the urging cam 27 is rotated counterclockwise by being driven by the urging cam driving motor 211. By this, the urging member holder 28 is rotated clockwise about the urging member rotation shaft 28*a*, so that a state in which the urging member 26 is disposed at a position where the urging member 26 is spaced from the intermediary transfer belt 7 is formed.

Incidentally, the present invention is not limited thereto, but this penetration amount (urging amount) may suitably be about 3.5 mm or less. In the case where the penetration amount (urging amount) is larger than this value, a load exerted on a contact surface between the urging member 26 and the intermediary transfer belt 7 increases, and therefore, there is a possibility that the intermediary transfer belt 7 is not readily rotated smoothly. Further, it is desirable that the urging member 26 is moved close to the inner roller 21 to the extent possible, but the urging member 26 may desirably be disposed so as not to contact the inner roller 21. The urging member 26 can be disposed so that the inner peripheral surface of the intermediary transfer belt 7 and the free end of the urging member 26 are in contact with each other at a position, for example, about 2 mm or more, typically about 10 mm or more away from the position, where the inner roller 21 and the intermediary transfer belt 7 are in contact with each other, toward an upstream side of the rotational direction of the intermediary transfer belt 7. Further, the urging member 26 can be disposed so that the inner peripheral surface and the intermediary transfer belt 7 and the free end of the urging member 26 are in contact with each other at a position, for example, about 40 mm or less, typically about 25 mm or less away from the position, where the inner roller 21 and the intermediary transfer belt 7 are in contact with each other, toward the upstream side of the rotational direction of the intermediary transfer belt 7. Further, the penetration amount Y may only be required to be a predetermined value when the recording material P passes through the neighborhood of an inlet of the secondary transfer nip N2 and the secondary transfer nip N2. The neighborhood of the inlet of the secondary transfer nip N2 is specifically a region corresponding to a region of the intermediary transfer belt 7 from a position, where the urging member 26 contacts the intermediary transfer belt 7, to the secondary transfer nip N2 with respect to the feeding direction of the recording material P.

4. Relationship Between Offset Amount and Penetration Amount

In the embodiment 1, the constitution in which the offset amount X is changed was described, but for example, the above-described "scattering" and the above-described image defect ("shock image") at the leading end and the trailing end of the recording material P which occur in the case where the rigidity of the recording material P is high (in the case where the thickness is large) can be effectively suppressed by causing the intermediary transfer belt 7 to project outward by disposing the urging member 26 on a side upstream of the secondary transfer nip N2 with respect to the rotational direction of the intermediary transfer belt 7. For that reason, in the case where when the rigidity of the recording material P is high (when the thickness is large), the offset amount X is changed so as to become small, it is desirable that the intermediary transfer belt 7 is projected outward by the urging member 26 in synchronism therewith. On the other hand, for example, in the case where the rigidity of the recording material P is low (in the case where the thickness is small), when the offset amount X is increased and the intermediary transfer belt 7 is projected outward by the urging member 26, the following phenomenon occurs. That is, the contact distance D becomes excessively large, the image defect such that the toner image is dynamically disturbed by friction between the toner image on the intermediary transfer belt 7 and the recording material P, i.e., a so-called "roughness" (or "toner image deviation") occurs in some instances.

Therefore, in this embodiment, in the case where the offset amount X is largely changed by changing a position of at least one of the inner roller 21 and the outer roller 9 (the position of the inner roller 21 in this embodiment), the image forming apparatus 100 employs a constitution in which the penetration amount Y is changed so as to be decreased by changing the position of the urging member 26 in synchronism therewith.

Incidentally, the change in offset amount X and penetration amount Y made in synchronism with each other means the following changes. Typically, in the case where the image is formed on a certain recording material P, when the offset amount X is changed before the recording material P reaches the secondary transfer nip N2, the above-described change refers to that the penetration amount Y is also changed before the recording material P reaches the secondary transfer nip N2. Further, as another example, for example, in the case where a predetermined adjusting operation such as an operation for applying a secondary transfer voltage is performed for controlling the secondary transfer voltage when the offset amount X is changed before a start of the adjusting operation, the above-described change refers to that the penetration amount Y is also changed before the start of the adjusting operation.

In this embodiment, in the case where the offset amount X is set at the "OF:S (first offset amount X1)" described in the embodiment 1, the penetration amount Y is set at 1.0 to 3.0 mm (for example, 1.5 mm as a representative value) which is "penetration amount: large (PA:L) (first penetration amount Y1)". Further, in this embodiment, in the case where the offset amount X is set at the "OF:L (second offset amount X2)" described in the embodiment 1, the penetration amount Y is set at 0 mm (spaced) which is "penetration amount: small (PA:S) (second penetration amount Y2)". That is, in the case where the inner roller 21 is disposed at a first inner roller position where the offset amount X is a first offset amount X1, in synchronism therewith, the urging member 26 is disposed at a first urging member position where the penetration amount y is a first penetration amount Y1. Further, in the case where the inner roller 21 is disposed at a second inner roller position where the offset amount X is a second offset amount X2 larger than the first offset amount X1, in synchronism therewith, the urging member 26 is disposed at a second urging member position where the penetration amount Y is a second penetration amount Y2 smaller than the first penetration amount Y1. The first offset amount X1 may be a positive value, 0, or a negative value, and the second offset amount X2 is typically the positive value. Further, the first penetration amount Y1 is positive value, and the second penetration amount Y2 may be 0 or the positive value.

Incidentally, in this embodiment, the urging member 26 can be spaced from the inner peripheral surface of the intermediary transfer belt 7, but the present invention is not limited thereto. In the case where the penetration amount Y is 0, the urging member 26 may also contact the intermediary transfer belt 7. Further, the second penetration amount Y2 may only be required to be smaller than the first penetration amount Y1 and a constitution in which the penetration amount Y is not 0 may also be employed.

The settings of offset amount X and the penetration amount Y are not limited to the above-described specific values. These values can be appropriately set through an experiment or the like from the viewpoints of the improvement in separation property of the recording material P from the intermediary transfer belt 7 and the suppression of the image defect occurring in the neighborhood of the secondary transfer nip N2 which are as described above. Further, levels of the changes in offset amount X and penetration amount Y are not limited to two levels. The change in offset amount X may also be made at three or more levels or continuously. Incidentally, in the case where the offset amount X is changeable to three or more levels, a constitution in which the penetration amount Y is not necessarily required to be decreased with an increasing offset amount X may also be employed. For example, in the case where a change amount of the offset amount X is small or in the case where the offset amount X is changed in a negative range, a degree of a fluctuation in the above-described contact distance D is small. In this case, the penetration amount Y is not necessarily required to be made small.

5. Control Mode

FIG. 7 is a schematic block diagram showing a control mode of a principal part of the image forming apparatus 100 in this embodiment. In FIG. 7, elements having identical or corresponding functions or constitutions to those shown in FIG. 3 are represented by the same reference numerals or symbols. In this embodiment, to the controller 200, the urging cam driving motor 211 and the urging cam position sensor 212 are connected. In this embodiment, the CPU 201 of the controller 200 is capable of controlling operations of the offset cam driving motor 213 and the urging cam driving motor 211 by using an offset amount/penetration amount table and a cam (offset cam, urging cam) driving amount conversion table which are stored in the ROM 220.

The image forming process and the change control of the offset amount X (FIG. 4) are similar to those in the embodiment 1. Further, in this embodiment, the operation of changing the penetration amount Y is performed in synchronism with the operation of changing the offset amount X. A table 2 schematically shows the offset amount/penetration amount table in this embodiment.

TABLE 2

| SHEET | SBW*1 (g/cm$^2$) | | | | |
|---|---|---|---|---|---|
| CATEGORY | ≤220 | 221-256 | 257-300 | 301-325 | 326-350 |
| NCP*2 | OA:L PA:S | OA:L PA:S | OA:L PA:S | OA:L PA:S | OA:S PA:L |

TABLE 2-continued

| SHEET | SBW*1 (g/cm$^2$) | | | | |
|---|---|---|---|---|---|
| CATEGORY | ≤220 | 221-256 | 257-300 | 301-325 | 326-350 |
| CP*3 | OA:L PA:S | OA:S PA:L | OA:S PA:L | OA:S PA:L | OA:S PA:L |

*1"SBW"is the sheet basis weight.
"OA:L" represents that the offset amount X is large.
"OA:S" represents that the offset amount X is small.
"PA:L" represents that the penetration amount Y is large.
"PA:S" represents that the penetration amount Y is small.
*2"NCP" is the non-coated paper.
*3"CP" is the coated paper.

6. Modified Embodiment

Parts (a) and (b) of FIG. 8 and parts (a) and (b) of FIG. 9 are schematic side views showing modified embodiments of the offset mechanism 17 and the urging mechanism 16, respectively, in this embodiment and each showing a principal part of the secondary transfer nip N2 and a portion in the neighborhood of the secondary transfer nip N2 as seen in a direction substantially parallel to the rotational axis direction of the inner roller 21 from one end portion side (from the front side on the drawing sheet of FIG. 1) of the inner roller 21 with respect to the rotational axis direction. Parts (a) and (b) of FIG. 8 are the side views for principally illustrating a structure and an operation of the offset mechanism 17 and in which some constituent elements relating to the urging mechanism 16 are represented by chain double-dashed lines for easy understanding. Further, parts (a) and (b) of FIG. 9 are the side views for principally illustrating a structure and an operation of the urging mechanism 16 and in which some constituent elements relating to the offset mechanism 17 are represented by chain double-dashed lines for easy understanding. Part (a) of FIG. 8 and part (a) of FIG. 9 show a state of the "OA:S" and the "PA:L", and part (b) of FIG. 8 and part (b) of FIG. 9 show a state of the "OA:L" and the "PA: S".

The offset mechanism 17 and the urging mechanism 16 in the modified embodiments shown in FIGS. 8 and 9 are constituted so that the urging mechanism 16 is operated in interrelation with the operation of the offset mechanism 17, and thus the offset amount X and the penetration amount Y can be changed in interrelation with each other.

In FIGS. 8 and 9, elements having functions or constitutions identical or corresponding to those of the offset mechanism 17 and the urging mechanism 16 shown in FIGS. 2 and 6, respectively, are represented by the same reference numerals or symbols and will be omitted from detailed description. However, in each of these modified embodiments, the offset cam 39 and the urging cam 27 are provided phase-fixedly to a common cam rotation shaft 110 so that the inner roller 21 and the urging member 26 can be moved in interrelation with each other in a predetermined relationship. That is, the offset cam 39 and the urging cam 27 are rotatable coaxially in interrelation with each other about the common cam rotation shaft 110 constituting the offset mechanism 17 and the urging mechanism 16. The common cam rotation shaft 110 is rotated by a common cam driving motor 113 constituting the offset mechanism 17 and the urging mechanism 16. By this, the urging mechanism 16 is capable of changing the penetration amount Y in interrelation with the operation of the offset mechanism 17. Thus, in this embodiment, the change in offset amount X and the change in penetration amount Y performed in synchronism with each other can be made by the single (common) driving source.

For that reason, according to these modified embodiments, it becomes possible to realize simplification of the structure of the image forming apparatus and cost reduction of the image forming apparatus.

7. Effect

As described above, according to this embodiment, an effect similar to the effect of the embodiment 1 can be achieved . Further, according to this embodiment, the image defect at the leading end and the trailing end of the recording material P occurring in the case where, for example, the rigidity of the recording material P is high (in the case where the thickness is large) can be suppressed.

Incidentally, the present invention is also applicable to the image forming apparatus 100 including only the urging mechanism 16 or the offset mechanism 17 and the urging mechanism 16. In this case, for example, in this embodiment, in place of the operation of the urging mechanism 16 performed in synchronism with the operation of the offset mechanism 17, only the urging mechanism 16 can be operated under a similar condition (thickness and surface property of the recording material P). Also, in such a constitution, by applying the present invention, it becomes possible to compatibly realize productivity of the mixed job and the image quality. That is, the controller 200 is capable of controlling the position changing mechanism 16 so that the urging amount of the urging member 26 against the belt when the toner image is transferred onto the recording material P for which the thickness indicated by the first information is larger than the predetermined value is a first urging amount and that the urging amount when the toner image is transferred onto the recording material P for which the thickness indicated by the first information is the predetermined value or less is a second urging amount smaller than the first urging amount or so that the urging member 26 is spaced from the belt 7. And, the controller 200 is capable of changing the above-described predetermined value so as to be smaller in the case where the toner image is transferred onto the recording material P for which the surface property indicated by the second information is the second surface property, smoother than the first surface property, than in the case where the toner image is transferred onto the recording material P for which the surface property indicated by the second information is the first surface property.

Other Embodiments

The present invention was described above based on specific embodiments, but is not limited thereto.

In the above-described embodiments, the constitution in which the offset amount is changed by changing the position of the inner roller is employed, but a constitution in which the offset amount changed by changing the position of the outer roller may also be employed. Further, the present invention is not limited to a constitution in which either one of the inner roller and the outer roller is moved, but may also employ a constitution in which the offset amount is changed by moving both the inner roller and the outer roller.

In the above-described embodiments, as an outer member for forming the secondary transfer nip in cooperation with the inner roller as an inner member, the outer roller directly contacting the outer peripheral surface of the intermediary transfer belt was used. On the other hand, a constitution in which as the outer member, the outer roller and a secondary transfer belt stretched by the outer roller and other rollers are used may also be employed. That is, the image forming apparatus may include, as the outer member, the stretching rollers, the outer roller and the secondary transfer belt stretched between these rollers. Further, the secondary transfer roller is contacted to the outer peripheral surface of the intermediary transfer belt by the outer roller. In such a constitution, by the inner roller contacting the inner peripheral surface of the intermediary transfer belt and the outer roller contacting the inner peripheral surface of the secondary transfer belt, the intermediary transfer belt and the secondary transfer belt are sandwiched, so that the secondary transfer nip is formed. In this case, a contact portion between the intermediary transfer belt and the secondary transfer belt is the secondary transfer nip as the secondary transfer portion. Incidentally, also in this case, the offset amount X is defined by the relative position between the inner roller and the outer roller similarly as described above. Further, the penetration amount Y is also defined similarly as described above by using the reference line L1 formed by the inner roller and the pre-secondary transfer roller and the urging portion tangential line L4 or by using the reference line L formed by the outer roller and the pre-secondary transfer roller and the urging portion tangential line L4'.

Further, in the above-described embodiments, the case of using the information on the recording material thickness, which is the information on the kind of the recording material relating to the rigidity of the recording material, was described. In the case where the sheet kind category or a brand (including a manufacturer, a product number or the like) is the same, the basis weight of the recording material and the thickness of the recording material are in a substantially proportional relationship in many instances (in which the basis weight is larger with an increasing thickness). Further, in the case where the sheet kind category or the brand is the same, the rigidity of the recording material and the basis weight or the thickness of the recording material are in a substantially proportional relationship in many instances (in which the rigidity is larger with an increasing basis weight or thickness). Accordingly, as the information on the thickness of the recording material, information on the basis weight or the rigidity can be used. Further, as the information on the thickness of the recording material and the information on the surface property of the recording material, for example, only qualitative information on a combination of the sheet kind category and the brand can be used. For example, the offset amount can be set in advance depending on the paper kind category, the brand or a combination of the sheet kind category and the brand. Also, in this case, each of the offset amount and the penetration amount is assigned on the basis of a difference in index value (thickness, basis weight, rigidity or the like) relating to the thickness between the recording materials or in index value (surface roughness, presence or absence of coating) relating to the surface property between the recording materials. Incidentally, the rigidity of the recording material can be represented by Gurley rigidity (stiffness) (MD/long fold) [mN] and can be measured by a commercially available Gurley stiffness tester.

In the above-described embodiments, as the offset mechanism and the urging mechanism, an actuator for actuating the movable portion by the cam was used, but the offset mechanism is not limited thereto. The offset mechanism and the urging mechanism may only be required to be capable of realizing an operation in conformity to each of the above-described embodiments, and for example, an actuator for actuating the movable portion by using a solenoid may be used.

Further, in the above-described embodiments, the case where the belt-shaped image bearing member was the intermediary transfer belt was described, but the present invention is applicable when an image bearing member constituted by an endless belt for feeding the toner image borne at the image forming position is used. Examples of such a belt-shaped image bearing member may include a photosensitive (member) belt and an electrostatic recording dielectric (member) belt, in addition to the intermediary transfer belt in the above-described embodiments.

Further, the present invention can be carried out also in other embodiments in which a part or all of the constitutions of the above-described embodiments are replaced with alternative constitutions thereof. Accordingly, when the image forming apparatus using the belt-shaped image bearing member is used, the present invention can be carried out with no distinction as to tandem type/single drum type, a charging type, an electrostatic image forming type, a developing type, a transfer type and a fixing type. In the above-described embodiments, a principal part relating to the toner image formation/transfer was described principally, but the present invention can be carried out in various uses, such as printers, various printing machines, copying machines, facsimile machines and multi-function machines, by adding necessary device, equipment and a casing structure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-105703 filed on Jun. 18, 2020, which is hereby incorporated by reference herein in its entirety.

What is claimed is:

1. An image forming apparatus comprising:

an image forming portion configured to form a toner image on an image bearing member;

an endless belt onto which the toner image is transferred from the image bearing member;

an inner roller stretching said endless belt in contact with an inner peripheral surface of said endless belt;

an outer member forming a transfer nip, where the toner image is transferred from said endless belt onto a recording material, in cooperation with said inner roller, said outer member being in contact with an outer peripheral surface of said endless belt;

a position changing mechanism configured to change a position of the transfer nip with respect to a circumferential direction of said inner roller by moving said inner roller, wherein said position changing mechanism is capable of changing a position of said inner roller to a plurality of positions including a first position and a second position positioned upstream of the first position with respect to a rotational direction of said endless belt;

an acquiring portion configured to acquire first information on a thickness of the recording material and second information on a surface property of the recording material; and a controller configured to control said position changing mechanism on the basis of the first information and the second information which are acquired by said acquiring portion, wherein during an image forming job for forming images on a plurality of recording materials including a first recording material and a second recording material subsequent to the first recording material, in a case that the position of said inner roller when the toner image is transferred onto the first recording material is the first position and that the first information acquired by said acquiring portion shows that a thickness of the second recording material is a first threshold or greater and a second threshold or less, in a case that the second information acquired by said acquiring portion shows that both the first recording material and the second recording material are coated paper, said controller controls said position changing mechanism so that the position of said inner roller when the toner image is transferred onto the second recording material is changed to the second position, and in a case that the second information acquired by said acquiring portion shows that both the first recording material and the second recording material are plain paper, said controller controls said position changing mechanism so that the position of said inner roller when the toner image is transferred onto the second recording material is maintained at the first position.

2. An image forming apparatus according to claim 1, wherein in a case that the second information acquired by said acquiring portion shows that both the first recording material and the second recording material are plain paper and in a case that the first information acquired by said acquiring portion shows that the thickness of the second recording material is the second threshold or greater, said controller changes the position of said inner roller to the second position when the toner image is transferred onto the second recording material.

3. An image forming apparatus according to claim 1, wherein the first information is information on a basis weight of the recording material.

4. An image forming apparatus according to claim 1, wherein said acquiring portion includes an operating portion capable of input of the second information through an operation by an operator.

5. An image forming apparatus according to claim 1, wherein said outer member is a roller member or an endless belt member.

6. An image forming apparatus comprising:

an image forming portion configured to form a toner image on an image bearing member;

an endless belt onto which the toner image is transferred from the image bearing member;

an inner roller stretching said endless belt in contact with an inner peripheral surface of said endless belt;

an outer member forming a transfer nip, where the toner image is transferred from said endless belt onto a recording material, in cooperation with said inner roller, said outer member being in contact with an outer peripheral surface of said endless belt;

a position changing mechanism configured to change a position of the transfer nip with respect to a circumferential direction of said inner roller by moving said inner roller, wherein said position changing mechanism is capable of changing a position of said inner roller to a plurality of positions including a first position and a second position positioned upstream of the first position with respect to a rotational direction of said endless belt;

an acquiring portion configured to acquire first information on a thickness of the recording material and second information on a surface property of the recording material; and a controller configured to control said position changing mechanism, wherein during an image forming job for forming images on a plurality of recording materials including a first recording material and a second recording material subsequent to the first recording material, in a case that the position of said inner roller when the toner image is transferred onto the first recording material is the first position and that the first information acquired by said acquiring portion shows that a thickness of the second recording material is a first threshold or greater and a second threshold or less, in a case that the second information acquired by said acquiring portion shows that both the first recording material and the second recording material are coated paper, the position of said inner roller when the toner image is transferred onto the second recording material is the second position, and in a case that the second information acquired by said acquiring portion shows that both the first recording material and the second recording material are plain paper, the position of said inner roller when the toner image is transferred onto the second recording material is the first position.

7. An image forming apparatus according to claim 6, wherein in a case that the second information acquired by said acquiring portion shows that both the first recording material and the second recording material are plain paper and in a case that the first information acquired by said acquiring portion shows that the thickness of the second recording material is the second threshold or greater, the position of said inner roller when the toner image is transferred onto the second recording material is the second position.

8. An image forming apparatus according to claim 6, wherein the first information is information on a basis weight of the recording material.

9. An image forming apparatus according to claim 6, wherein said acquiring portion includes an operating portion capable of input of the second information through an operation by an operator.

10. An image forming apparatus according to claim 6, wherein said outer member is a roller member or an endless belt member.

* * * * *